US007887168B2

(12) United States Patent
Shimizu et al.

(10) Patent No.: US 7,887,168 B2
(45) Date of Patent: Feb. 15, 2011

(54) LIQUID DROPLET JETTING APPARATUS AND METHOD OF EXCHANGING MAIN TANK

(75) Inventors: Yoichiro Shimizu, Kasugai (JP); Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 298 days.

(21) Appl. No.: 12/165,420

(22) Filed: Jun. 30, 2008

(65) Prior Publication Data

US 2009/0002433 A1 Jan. 1, 2009

(30) Foreign Application Priority Data

Jun. 29, 2007 (JP) ..... 2007-171392

(51) Int. Cl.
*B41J 2/175* (2006.01)

(52) U.S. Cl. ..... 347/85; 347/50; 347/86

(58) Field of Classification Search ..... 347/85, 347/86, 50

See application file for complete search history.

(56) References Cited

U.S. PATENT DOCUMENTS

| | | | | |
|---|---|---|---|---|
| 6,168,268 | B1 * | 1/2001 | Sugiyama | 347/89 |
| 6,243,115 | B1 * | 6/2001 | Baker et al. | 347/85 |
| 6,299,296 | B2 * | 10/2001 | Gasvoda | 347/85 |
| 6,612,683 | B2 * | 9/2003 | Takahashi et al. | 347/30 |
| 7,185,974 | B2 | 3/2007 | Katayama | |
| 7,278,722 | B2 * | 10/2007 | Sasaki et al. | 347/86 |
| 7,614,710 | B2 * | 11/2009 | Haines et al. | 347/7 |
| 2003/0210309 | A1 * | 11/2003 | Kimura et al. | 347/85 |
| 2006/0001715 | A1 * | 1/2006 | Umeda et al. | 347/86 |
| 2006/0028519 | A1 * | 2/2006 | Nakamura et al. | 347/87 |
| 2006/0120879 | A1 * | 6/2006 | Sugahara | 417/50 |
| 2007/0285474 | A1 * | 12/2007 | Murakami | 347/85 |

FOREIGN PATENT DOCUMENTS

| | | |
|---|---|---|
| JP | 2005066906 A | 3/2005 |
| JP | 2005161637 A | 6/2005 |

* cited by examiner

*Primary Examiner*—Ellen Kim
(74) *Attorney, Agent, or Firm*—Baker Botts LLP

(57) ABSTRACT

A main tank has a storage space which stores a liquid. A sub tank has a predetermined interior space and an atmosphere communicating hole which makes the interior space communicate with an atmosphere, formed therein, and has an opening and closing valve which opens and closes the atmosphere communicating hole. When the main tank is not mounted on a main tank installing portion, the opening and closing valve closes the atmosphere communicating hole. When the main tank is mounted on the main tank installing portion, a discharge operation of discharging the liquid from the nozzles of the head with the atmosphere communicating hole closed by the opening and closing valve is carried out. Thereafter, the opening and closing valve opens the atmosphere communicating hole. Accordingly, the liquid is prevented from being leaked out from the sub tank when the main tank is removed.

12 Claims, 14 Drawing Sheets

LIQUID DROPLET JETTING APPARATUS AND METHOD OF EXCHANGING MAIN TANK

CROSS-REFERENCE TO RELATED APPLICATION

The present application claims priority from Japanese Patent Application No. 2007-171392, filed on Jun. 29, 2007, the disclosure of which is incorporated herein by reference in its entirety.

BACKGROUND OF THE INVENTION

1. Field of the Invention

The present invention relates to a liquid droplet jetting apparatus such as an ink-jet printing apparatus (ink-jet printer) which includes a head which jets a liquid from nozzles.

2. Description of the Related Art

As a typical example of a liquid droplet jetting apparatus, an ink-jet printer which includes an ink supply channel which supplies an ink to a head, and a mounting portion on which a cartridge-type main tank storing the ink is mounted detachably, has hitherto been known widely. When the main tank is mounted on the mounting portion, the ink in the main tank is supplied to the head via the ink supply channel.

In a case of replacing the main tank by a new main tank when the ink in the ink tank has run down, there is a possibility that air enters the ink supply channel. To cope with this, an ink-jet printer provided with a sub tank (buffer tank) which is open to the atmosphere between the head and the ink supply channel so that air does not enter the ink supply channel even when the ink in the ink cartridge has run down has hitherto been known (Japanese Patent Application Laid-open Publication No. 2005-66906). An atmosphere opening hole, which makes an internal space storing the ink, communicate with the atmosphere is formed in the sub tank. According to such structure, even when the ink in the ink tank has run down, the air does not enter into the ink supply tube (channel) because the ink is remained in the sub tank. Furthermore, even when the air enters into a connecting portion between the main tank and the sub tank at the time of replacing the main tank, the air is separated from the ink by buoyancy (buoyant force) in the sub tank. Therefore, the entry of the air into the ink supply channel is prevented.

In the invention described in Japanese Patent Application Laid-open No. 2005-66906, a communicating hole which communicates with an ink cartridge is provided in a ceiling portion of the sub tank, and the ink cartridge is mounted in a perpendicular direction. Consequently, even when the ink cartridge removed, since the communicating hole is positioned above a level of the ink, the ink filled in the sub tank is not leaked from (through) the communicating hole.

On the other hand, an ink-jet printer in which the ink-jet cartridge is mounted from a horizontal direction (slid horizontally from a side) has also been proposed, and is in accordance with the preference and liking for operability and design of users.

SUMMARY OF THE INVENTION

The applicant of this patent application took into consideration and examined use of the ink cartridge described in Japanese Patent Application Laid-open No. 2005-66906 in such ink-jet printer. In this case, since a communicating hole which communicates with an ink cartridge is formed in a side surface of a sub tank, the communicating hole may be positioned below (at a lower side) of an ink level according to a quantity remained of the ink. Therefore, it has been revealed that there is a possibility of the ink leaking through the communicating hole when the ink cartridge is removed.

The present invention is made to solve this problem, and an object of the present invention is to provide a liquid droplet jetting apparatus which includes a sub tank, in which it is possible to prevent a leakage of a liquid when the ink tank is removed, even with a structure such that the communicating hole which communicates with the main tank may be positioned at a lower side of the liquid level.

According to a first aspect of the present invention, there is provided a liquid droplet jetting apparatus which jets, onto a recording medium, droplets of a liquid supplied from a main tank, including:

a main tank installing portion in which the main tank is detachably installed, the main tank having a storage space formed therein to store the liquid;

a sub tank which is arranged adjacent to the main tank installing portion, which is connected to the main tank when the main tank is installed in the main tank installing portion, and which has an interior space formed therein to store the liquid, an atmosphere communicating hole formed to communicate the interior space with an atmosphere, an inflow portion through which the liquid flows into the sub tank, and a valve which opens and closes the atmosphere communicating hole; and a head having a nozzle surface in which a plurality of nozzles through which the liquid supplied via the sub tank are jetted are formed, wherein when the main tank is connected to the sub tank, the storage space communicates with the interior space via the inflow portion;

when the main tank is detached from the main tank installing portion, the valve closes the atmosphere communicating hole; and when the main tank is installed in the main tank installing portion, a discharge operation is performed in which the liquid is discharged from the interior space while the atmosphere communicating hole is closed, and then the valve opens the atmosphere communicating hole.

According to the first aspect of the present invention, since the atmosphere communicating hole is closed when the main tank is removed, the liquid stored in the sub tank does not leak out through the inflow portion. Moreover, when the main tank is installed, first of all, the liquid is discharged from the interior space with the atmosphere communicating hole closed. Accordingly, even when air enters at the time of installing the main tank, and a meniscus is formed in the inflow portion, it is possible to destroy the meniscus which is formed in the inflow portion. When the discharge operation of discharging the liquid is performed, the valve opens the atmosphere communicating hole. Therefore, by using a water head pressure it is possible to make the liquid flow in smoothly from the main tank side toward the sub tank. Moreover, it is possible to prevent a leakage of the liquid when the main tank is removed, and to supply the liquid smoothly from the main tank side toward the sub tank at the time of installing the main tank.

The liquid droplet jetting apparatus of the present invention may further include a carriage which reciprocates in a predetermined direction with the head mounted thereon; wherein the valve may open or close the atmosphere communicating hole depending on a position of the carriage. The liquid droplet jetting apparatus of the present invention may further include a cap mechanism which seals the nozzle surface of the head; wherein the valve may close the atmosphere communicating hole when the carriage is positioned at a printing position at which an operation of jetting the liquid onto the recording medium from the nozzles is performed, or at a cap position at which the nozzle surface is sealed by the cap mechanism; and the valve may open the atmosphere communicating hole when the carriage is positioned at a standby position which is different from the printing position and the cap position.

In this case, it is possible to perform the opening and closing operation of the valve by using a movement control of the carriage which has hitherto been carried out, and to realize the movement control of the valve by a simple structure (arrangement).

In the liquid droplet jetting apparatus of the present invention, when the carriage is positioned at the cap position, the main tank may be detachable with respect to the main tank installing portion.

In this case, since detaching and attaching of the main tank is performed when the nozzle opening surface is sealed, it is possible to prevent drying of the liquid around the nozzles.

In the liquid droplet jetting apparatus of the present invention may further include a liquid jetting mechanism which is provided on the head, wherein in the discharge operation, the carriage may be moved to the printing position, and the liquid jetting mechanism may perform printing on the recording medium by jetting the liquid from the nozzles.

In this case, since it is possible to use the liquid which is discharged for destroying the meniscus, for printing, it is possible to reduce an amount of liquid which is wasted.

The liquid droplet jetting apparatus of the present invention may further include a suction mechanism which sucks the liquid through the cap mechanism; wherein in the discharge operation, the carriage may be moved to the cap position, and the suction mechanism may suck the liquid from the nozzles in the discharge operation during which the nozzle surface is sealed by the cap mechanism.

In this case, it is possible to carry out the discharge operation for destroying the meniscus without the movement of the carriage, it is possible to shorten a time till the meniscus is destroyed.

In the liquid droplet jetting apparatus of the present invention, the atmosphere communicating hole may be formed in a side surface of the sub tank, the side surface facing the carriage when the carriage is positioned at the standby position; the valve may have an arm which is swingably installed between the sub tank and the carriage, a valve element which is provided at one end of the arm, an operating piece which is provided at the other end of the arm, and a bias applying member which applies a bias on the arm in a direction such that the valve member closes the atmosphere communicating hole;

when the carriage is positioned at the printing position or the cap position, the carriage may be away from the operating piece and the atmosphere communicating hole may be closed by the valve member; and when the carriage is positioned at the standby position, the operating piece may be pressed by the carriage to swing the arm, resisting the bias by the bias applying member, and the valve body may be away from the atmosphere communicating hole and the atmosphere communicating hole may be opened.

In this case, it is possible to realize by a simple structure, the valve operating mechanically which opens and closes the atmosphere communicating hole by the operating piece being operated by the carriage.

In the liquid droplet jetting apparatus of the present invention, one end of the operating piece of the valve may be contactable to the carriage, the one end being wedge-shaped and chamfered on one side in the predetermined direction. Moreover, in the liquid droplet jetting apparatus of the present invention, the valve may have a second bias applying member which pushes the operating piece toward the carriage; the carriage may have a protruding portion which is formed on the carriage and is engaged with the operating piece; when the carriage moves from the one side in the predetermined direction to the other side, the protruding portion may press the operating piece, resisting the second bias applying member, in a direction away from the carriage; and when the carriage moves from the other side in the predetermined direction to the one side, the protruding portion may be engaged with the operating piece to swing the arm, resisting the bias by the bias applying member.

Since the one end of the operating piece making a contact with the carriage has a substantially triangular wedge shape, when the carriage makes a contact with the operating piece from a side of an inclined surface which is chamfered, it is possible to push the operating piece in a direction of separating away from the carriage. Accordingly, it is possible to let escape the operating piece moving away from the carriage. Whereas, when the carriage makes a contact with the operating piece from a side opposite to the inclined surface which is chamfered, it is possible to push the operating piece in a direction of movement of the carriage. Accordingly, it is possible to open the valve by rotating (swinging) the arm. In this manner, it is possible to change a direction of a force exerted on the operating piece according to the direction of movement of the carriage. Therefore, it is possible to make the arm rotate only when the carriage moves in a predetermined direction.

In the liquid droplet jetting apparatus of the present invention, the main tank may include a plurality of individual main tanks, and the individual main tanks may be detachably installed in the main tank installing portion; the sub tank may include a plurality of individual sub tanks which are to be connected corresponding to the individual main tanks installed in the main tank installing portion, respectively; and the atmosphere communicating hole may be formed as a plurality of communicating holes each of which is formed in one of the individual sub tanks, and the valve may open and close simultaneously the atmosphere communicating holes of the individual sub tanks.

In this case, even when it is a liquid droplet jetting apparatus which is capable of jetting the liquid supplied from the plurality of (individual) main tanks, it is possible to suppress an increase in a manufacturing cost, due to the structure of the opening and closing valve becoming simple.

In the liquid droplet jetting apparatus of the present invention, the individual sub tanks may be aligned in a predetermined aligning direction; and the atmosphere communicating holes may be arranged in the aligning direction to be concentrated with a density higher than a density of the sub tanks.

In this case, it is possible to structure compactly the valve body of the valve, and a mountability of the valve on (with respect to) the liquid jetting apparatus is improved.

According to a second aspect of the present invention, there is provided a method of exchanging a main tank of the liquid droplet jetting apparatus according to the present invention, including:

detecting a remaining amount of the liquid in the main tank;

moving the carriage to the cap position when the remaining amount of the liquid is less than a predetermined amount;

exchanging the main tank;

sucking the liquid by the suction mechanism, while the carriage is positioned at the cap position; and moving the carriage to the standby position after the liquid has been sucked.

According to the second aspect of the present invention, it is possible to prevent a leakage of the liquid when the main tank is removed, and to supply the liquid smoothly from the side of the main tank toward the sub tank at the time of installing the main tank. Moreover, since it is possible to drive the valve by a drive of the carriage, a special purpose control unit such as an electromagnetic valve is not necessary. Therefore, it is possible to simplify a structure of a control unit of the liquid droplet jetting apparatus.

DETAILED DESCRIPTION OF THE PREFERRED EMBODIMENTS

An exemplary embodiment of the present invention will be described below with reference to the accompanying diagrams. In the following description, as shown in FIGS. 1 to 9, regarding a multi-function device CM (refer to FIG. 1) which includes a printer unit (printer apparatus) shown as the embodiment of the liquid droplet jetting apparatus according to the present invention, a front surface side, a rear surface side, a left side as seen from the front surface of the multi-function device CM, and a right side as seen from the front surface of the multi-function device are described as a front side, a rear side, a left side, and a right side respectively.

Figure 1:
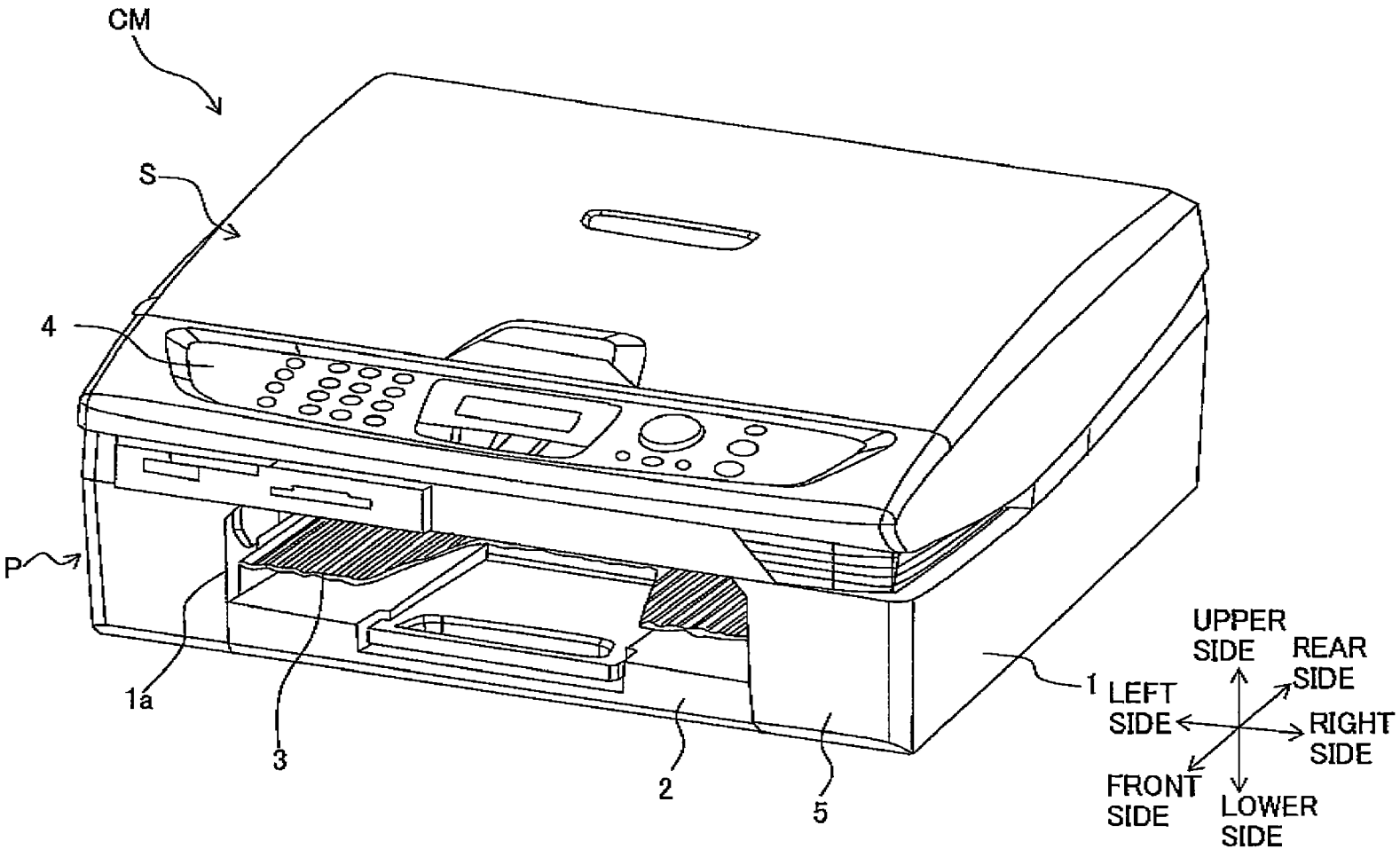
FIG. 1 is a perspective view of a multi-function device having a printer unit (apparatus) which is an embodiment of a liquid droplet jetting apparatus according to the present invention.

FIG. 1 is a perspective view showing an appearance of the multi-function device CM. As shown in FIG. 1, the multi-function device CM is a multi-function apparatus having a printer function, a scanner function, a copy function and a facsimile function, and includes an ink-jet printer unit P at a lower portion of a casing 1, and a scanner unit S at an upper portion of the casing 1. At a lower stage of an opening 1*a* formed at a center of a front surface central portion of the casing 1, a paper feeding tray 2 which accommodates stacked recording papers M is provided, and at an upper stage of the opening 1*a*, a paper discharge tray 3 which is capable of accommodating the recording papers M having an image recorded thereon is provided. At a front surface upper portion of the casing 1, an operation panel 4 for imparting operation commands to the multi-function device CM including the printer unit P is provided.

Figure 2:
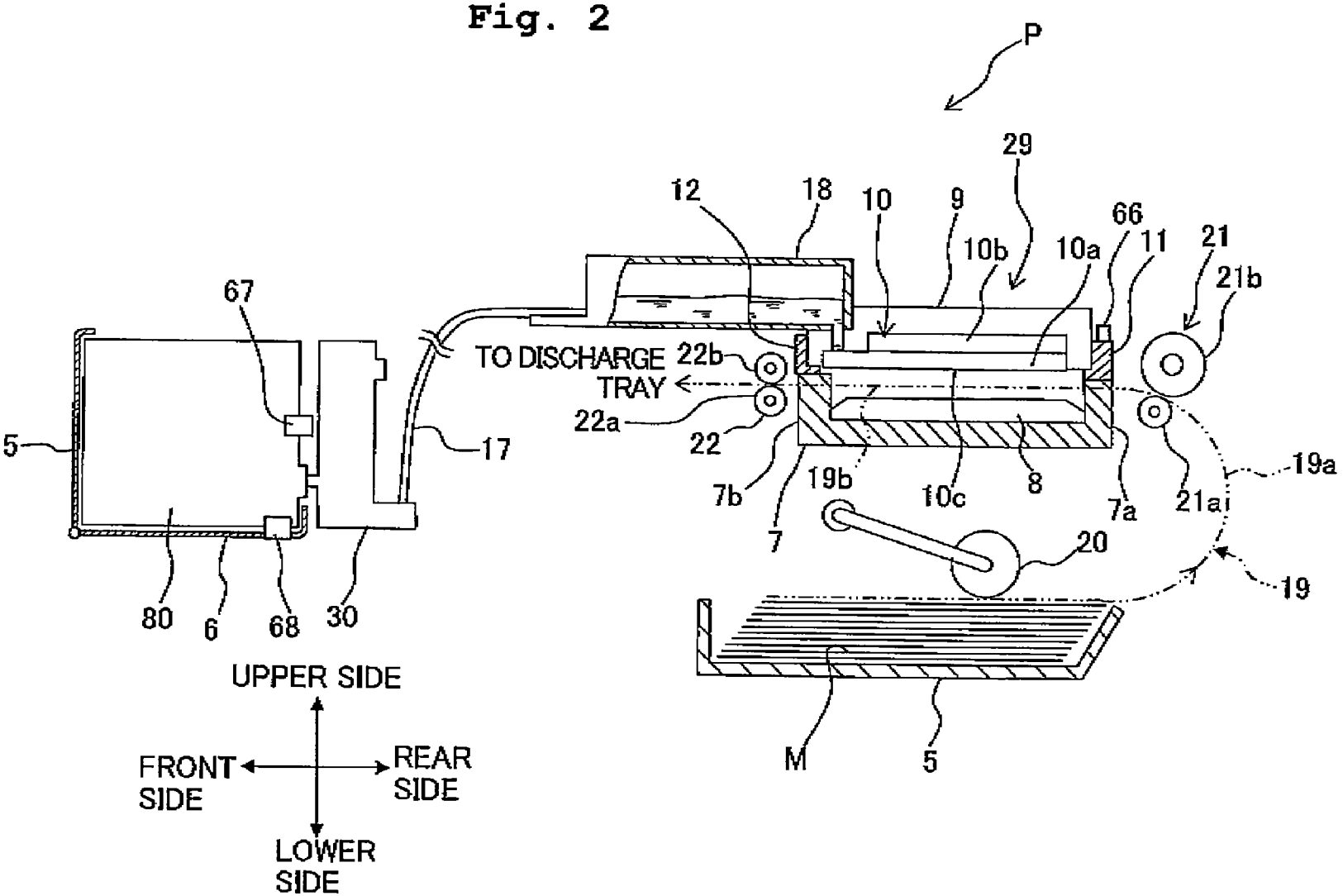
FIG. 2 is a side cross-sectional view showing a schematic structure of the printer unit.
Figure 3:
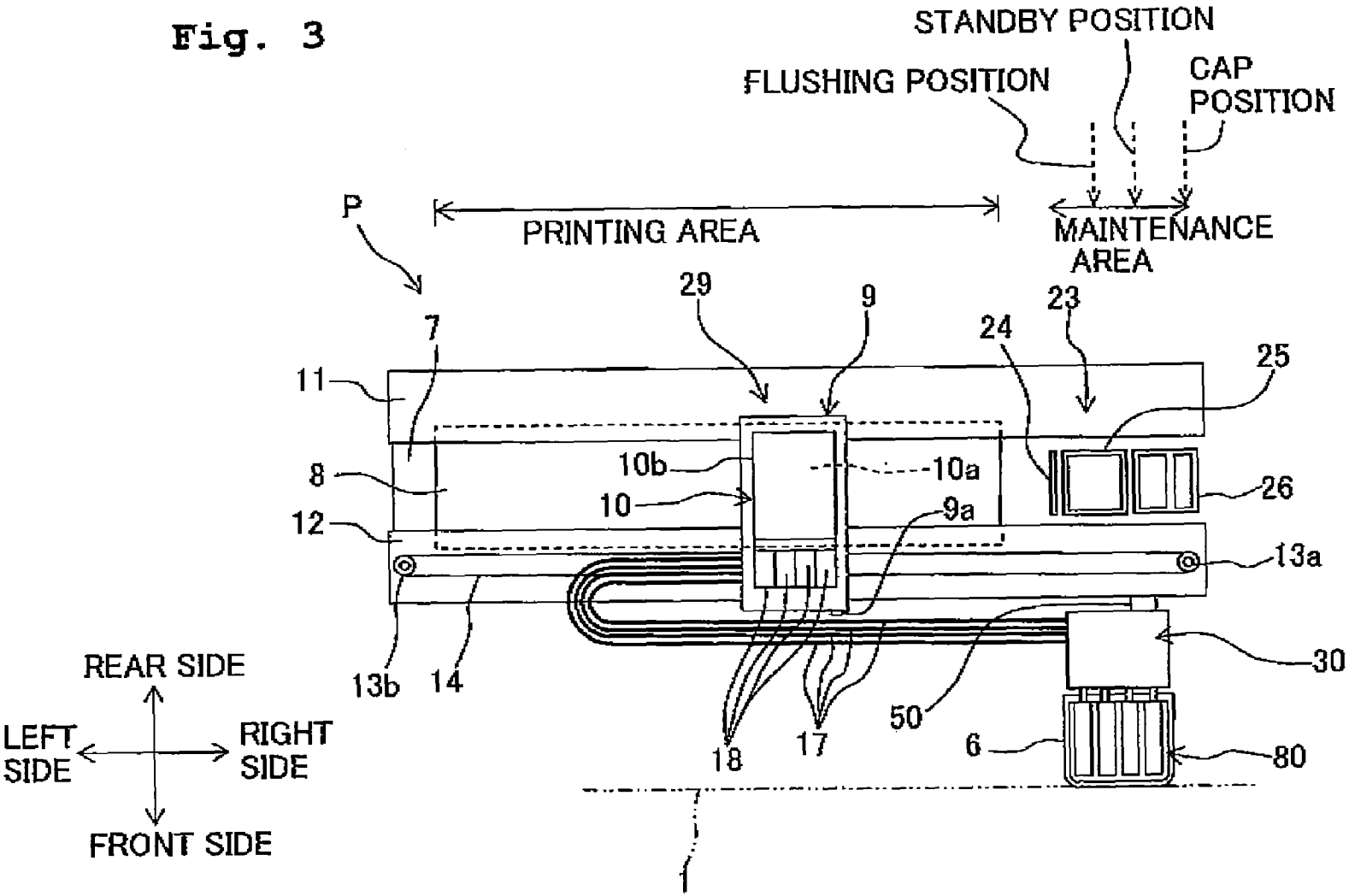
FIG. 3 is a plan view showing a schematic structure of the printer unit.

FIG. 2 is a side view showing a schematic structure of the printer unit P, and FIG. 3 is a plan view showing a schematic structure of the printer unit P. As shown in FIG. 1 and FIG. 2, a door 5 is openably provided at a right side of the front surface lower portion of the casing 1, and a main tank installing portion 6 on which a main tank (an ink cartridge) 80 is detachably mounted is provided at an inner side of the door 5. When the door 5 opens, the main tank installing portion 6 is exposed to a front side, and an operator can carry out a replacement upon detaching of a main tank 80 in a front and rear direction (horizontal direction). This printer unit P is capable of carrying out a full-color printing by jetting inks of four different colors (namely, cyan, magenta, yellow, and black). As shown in FIG. 3, four main tanks (individual main tanks) 80 in which inks of four colors are stored are installed to be arranged from left to right, in the main tank installing portion (main tank mounting portion) 6.

At a center of a bottom of an interior of the casing 1, the paper feeding tray 2 mentioned above is provided. On an upper side of the paper feeding tray 2, a main frame 7 in the form of a rod having a U-shaped cross-section, an upper surface of which is open, is provided to be extended in a left right direction (horizontally). A platen 8 in the form of a plate which is longer in left right direction is provided, covering an open surface of the main frame 7. Above the platen 8, an image recording unit 29, in which a jetting head 10 which jets an ink in the carriage 9 is mounted, is provided, the carriage 9 being reciprocatable in the left and right direction.

A guide frame 11 is provided at an upper end edge of a rear wall 7*a* of the main frame 7, and a carriage frame 12 is provided at an upper end edge of a side wall 7*b* of the main frame 7. The guide frame 11 and the carriage frame 12 are extended in parallel along the left and right direction. The carriage 9 is installed between the guide frame 11 and the carriage frame 12, and is slidably supported on both sides (left and right sides) by the guide frame 11 and the carriage frame 12. As shown in FIG. 3, the carriage 9 is coupled with a belt 14 which is put around between pulleys 13*a* and 13*b* which are provided to be separated on both sides (left and right sides) to the carriage frame 12. The pulleys 13*a* and 13*b*, and the belt 14 are driven to be rotated in a normal and a reverse direction by a carriage motor 15 (refer to FIG. 10). With the rotation of the pulleys 13*a* and 13*b*, and the belt 14, the carriage 9 reciprocates in left and right direction along the guide frame 11 and the carriage frame 12. The carriage motor 15 is installed on a motor plate 16 (refer to FIG. 9) which is engaged with a right end portion of a lower end surface of the carriage frame 12.

The jetting head 10 includes a cavity unit 10*a* in which the ink flows, and a drive portion 10*b* which is driven by a piezoelectric effect. When the drive portion 10*b* is driven, a pressure is applied to the ink in the cavity unit 10*a*, and the ink is jetted through nozzles (not shown in the diagram) which is formed in a lower end surface (nozzle opening surface and nozzle surface) 10*c* of the cavity unit 10*a*. With the jetting head 10 mounted on the carriage 9, the nozzle opening surface 10*c* is arranged between the guide rail 11 and carriage frame 12.

As shown in FIG. 2, the main tank 80 installed on the main tank installing portion 6 is connected to a sub tank (individual sub tank) 30 which will be described later. The ink which is supplied from the main tank 80 flows into the sub tank 30, and is guided to a buffer tank 18 which is provided at an upper portion of the jetting head 10 via a supply tube 17 having a flexibility. Furthermore, the ink is supplied from the buffer tank 18 to the cavity unit 10*a* of the jetting head 10.

A path (paper transporting path) 19, through which the recording paper M is transported, is installed to be extended at a rear side of the paper feeding tray 2. The paper transporting path 19 includes a bent portion 19*a* which is directed upward from a rear side of the paper feeding tray 2, and is further bent to be directed frontward, and a horizontal portion 19*b* which is extended frontward from a dead end of the bent portion 19*a*, and is connected to the paper discharge tray 3. Directly over the paper feeding tray 2, a paper feeding roller 20 which supplies the recording papers M in the paper feeding tray 2 to the paper transporting path 19 is provided. At a downstream portion of the bent portion 19*a*, a pair of transporting rollers 21 including two rollers arranged vertically, namely, a transporting roller 21*a* and a pinch roller 21*b*, is provided to sandwich the paper transporting roller 19 from an upper and a lower sides. At a downstream portion of the horizontal portion 19*b*, a pair of paper discharge rollers 22 including two rollers arranged vertically, namely, a paper discharge roller 22*a* and a pinch roller 22*b*, is provided to sandwich the paper transporting roller 19 from the upper and the lower sides. Moreover, the platen 8 and the jetting head 10 of the image recording unit 29 are provided between the pair of transporting rollers 21 and the pair of paper discharge rollers 22, sandwiching the horizontal portion 19*b* from the upper and the lower sides.

According to this structure, the recording paper M in the paper feeding tray 2 is supplied to the bent portion 19*a* by the paper feeding roller 20, and is transported to the horizontal portion 19*b* by the pair of transporting rollers 21. When the recording paper M passes over the platen 8 at the horizontal portion 19*b*, the ink is jetted from the jetting head 10 of the image recording unit 29 which is scanned to left and right above the platen 8. In this manner, the printer unit P carries out a printing operation on the recording paper M. The recording paper M with an image recorded thereon is discharged from the paper transporting path 19 to the paper discharge tray 3 by the pair of paper discharge rollers 22.

Furthermore, as shown in FIG. 3, a station 23 for carrying out maintenance of the jetting head 10 is installed at a right side of the platen 8 between the front wall 7*b* and the rear wall 7*a* of the main frame 7. The station 23 includes a wiper blade 24, a waste ink receiving tray 25, and a suction cap 26.

The wiper blade 24 is arranged adjacent to a right side of the platen 8, and is capable of ascending and descending by a wiper driving section (not shown in the diagram). When the image recording unit 29 moves to right from a side of the platen 8, and passes above the wiper blade 24, the wiper blade 24 ascends (rises) up by an operation of the wiper driving section and makes a contact with the nozzle opening surface 10*c* from a lower side. Accordingly, ink dregs which are adhered to the nozzle opening surface 10*c* are wiped off. The waste-ink receiving tray 25 is arranged adjacent to a right side of the wiper blade 24, and receives the ink jetted from the jetting head 10 of the image recording unit 29 staying above the waste ink receiving tray 25. This jetting operation of the ink is carried out by the drive portion 10*b*, and is distinguished from a jetting of the ink on to the recording paper M, and is also called as a flushing operation. By this flushing operation, even after the wiping operation is carried out, it is possible to maintain and recover a state in which the ink is filled up to an opening edge of the nozzle holes.

The suction cap 26 is formed of an elastic material such as rubber, and is arranged adjacent to a right side of the waste ink receiving tray 25. The suction cap 26 can be ascended by a cap driving section 27 (refer to FIG. 10). When the image recording unit 29 is positioned above the suction cap 26, the suction cap 26 ascends due to an operation of the cap driving section 27, and makes a close contact with the nozzle opening surface 10*c* from a lower side. Accordingly, the nozzle holes are covered by the suction cap 26. In other words, the suction cap 26 is covered by the nozzle opening surface 10*c*, and a sealed space is formed at an interior of the suction cap 26. In such manner, by sealing the nozzle opening surface 10*c* in which the nozzle holes are formed, with the suction cap 26, when the printing operation is not carried out, the drying of the ink around the nozzle holes is prevented thereby preventing blocking of the nozzle holes. Furthermore, a purge pump 28 (refer to FIG. 10) which communicates with the sealed space is connected to the suction cap 26 via a suction tube which is not shown in the diagram. When the purge pump 28 is driven with the nozzle holes in a sealed state, a negative pressure is generated inside the sealed space. Due to the negative pressure, it is possible to suck the ink forcibly from the nozzle holes even when the drive section 10*b* is not operated. Due to this suction operation, even when there is a drying of the ink around the nozzle holes, it is possible to remove the ink hardened by drying.

As shown in FIG. 3, in a scanning range of the image recording unit 29, an area facing the platen 8, in which the printing operation is carried out is called as a printing area, and an area facing the station 23 is called as a maintenance area. In the maintenance area, a position facing the waste ink receiving tray 25, at which the flushing operation is carried out is called as a flushing position, and a position facing the suction cap 26, at which a sealing operation and a suction operation are carried out is called as a cap position (capping position). These positions are arranged in order of the flushing position, the standby position, and the cap position along a direction of separating away from the printing area in a scanning direction of the image recording unit 29, at a right end side of the printing area. Moreover, the cap position is a right-end limit position in the scanning range of the image recording unit 29.

Figure 4:
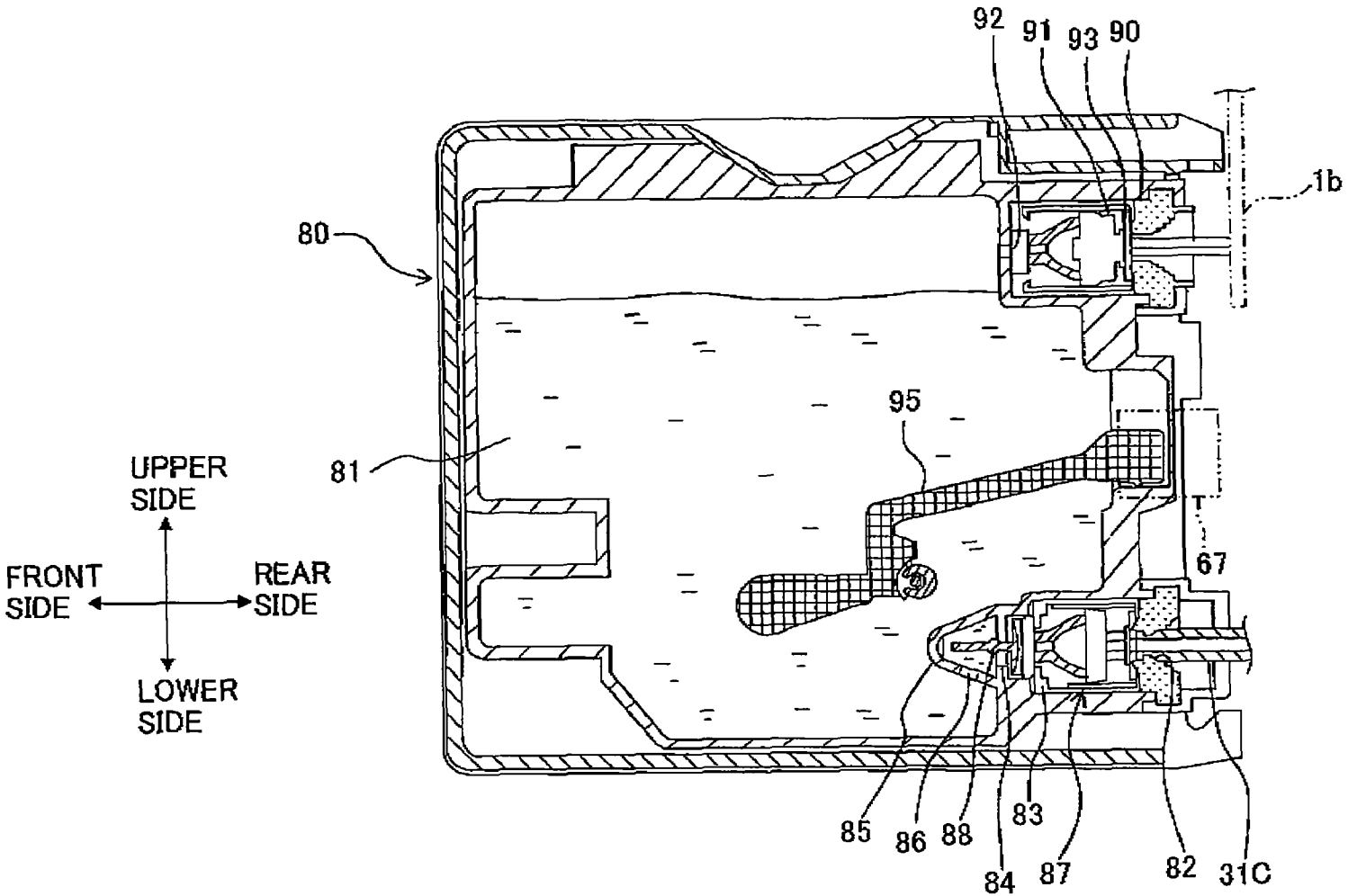
FIG. 4 is a side cross-sectional view of a main tank which is mounted on the printer unit.

FIG. 4 is a side cross-sectional view of the main tank 80. The main tank 80 has an ink storage chamber 81 in which the ink is stored. An ink supply hole 82 for supplying the ink inside the ink storage chamber 81 toward the sub tank 30 is formed at a lower portion of a rear end surface of the main tank 80. The ink supply hole 82 communicates with a lower portion valve accommodating chamber 83 which is formed to be cylindrical-shaped, at an interior of the main tank 80. Moreover, a valve hole 84 is formed at an inner surface of the lower portion valve accommodating chamber 83. A cover portion 85 having a hollow conical shape is formed around the valve hole 84, to be protruded toward inside the ink storage chamber 81. A communicating hole 86 is formed at a lower portion of the cover portion 85, and the ink storage chamber 81 and the lower portion valve accommodating chamber 83 communicate via the valve hole 84 and the communicating hole 86. An ink supply valve 87 is provided in the lower portion valve accommodating chamber 83, and a non-return valve 88 is provided to the valve hole 84. Moreover, an atmosphere communicating hole 90 which opens the ink storage chamber 81 to an atmosphere is formed at an upper portion of a rear end surface of the main tank 80. The atmosphere communicating hole 90 communicates with an upper portion valve accommodating chamber 91 which is installed to be extended toward the interior of the main tank 80. A communicating hole 92 is formed in an inner surface of the upper portion valve accommodating chamber 91, and the ink storage chamber 81 and the upper portion valve accommodating chamber 91 communicate via the communicating hole 92. An atmosphere opening valve 93 which opens and closes the atmosphere communicating hole 90 is accommodated inside the upper portion valve accommodating chamber 91. Furthermore, a sensor arm 94 which swings according to a position of a height of a liquid level of the ink is provided in the ink storage chamber 81. An ink remainder detector 68 (refer to FIG. 1 and also FIG. 10) which detects that the sensor arm 94 has swung to be inclined forward through a predetermined angle with a descent of the liquid level (in other words, which detects that the liquid level has descended up to a predetermined height) is provided in the casing 1. The ink supply valve 87 closes the ink supply hole 82 when the main tank 80 is not installed in the main tank installing portion 6, and opens the ink supply hole 82 by moving in an axial direction by a needle portion 31C of the sub tank 30 when the main tank 80 is installed in the main tank installing portion 6. The atmosphere opening valve 93 closes the atmosphere communicating hole 90 when the main tank 80 is not installed in the main tank installing portion 6, and opens the atmosphere communicating hole 90 by making a contact with an inner wall 1*b* provided at an inner side of the casing 1, when the main tank 80 is installed in the main tank installing portion 6. Accordingly, the ink storage chamber 81 is opened to the atmosphere.

Figure 5:
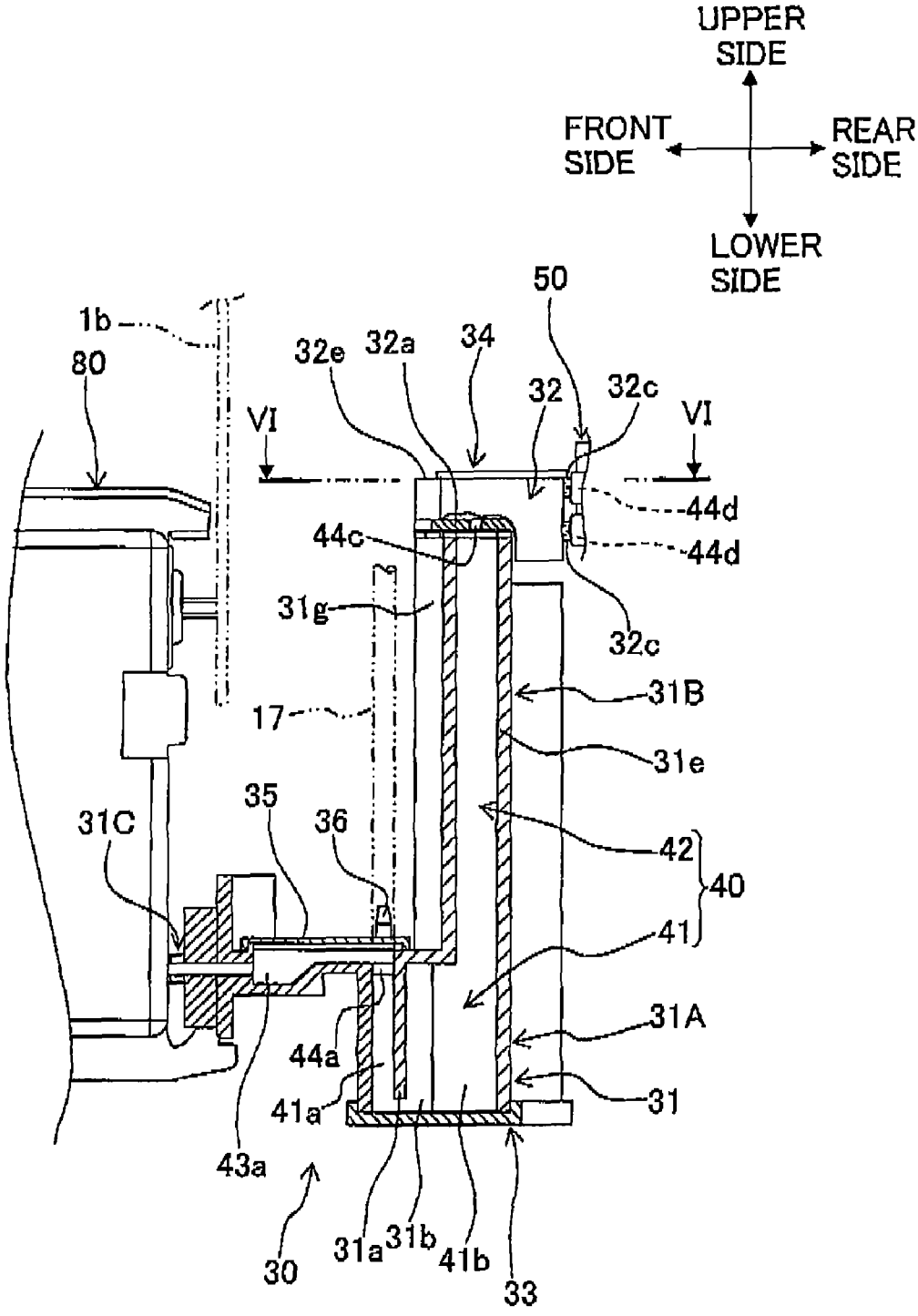
FIG. 5 is a side cross-sectional view of a sub tank of the printer unit.
Figure 6:
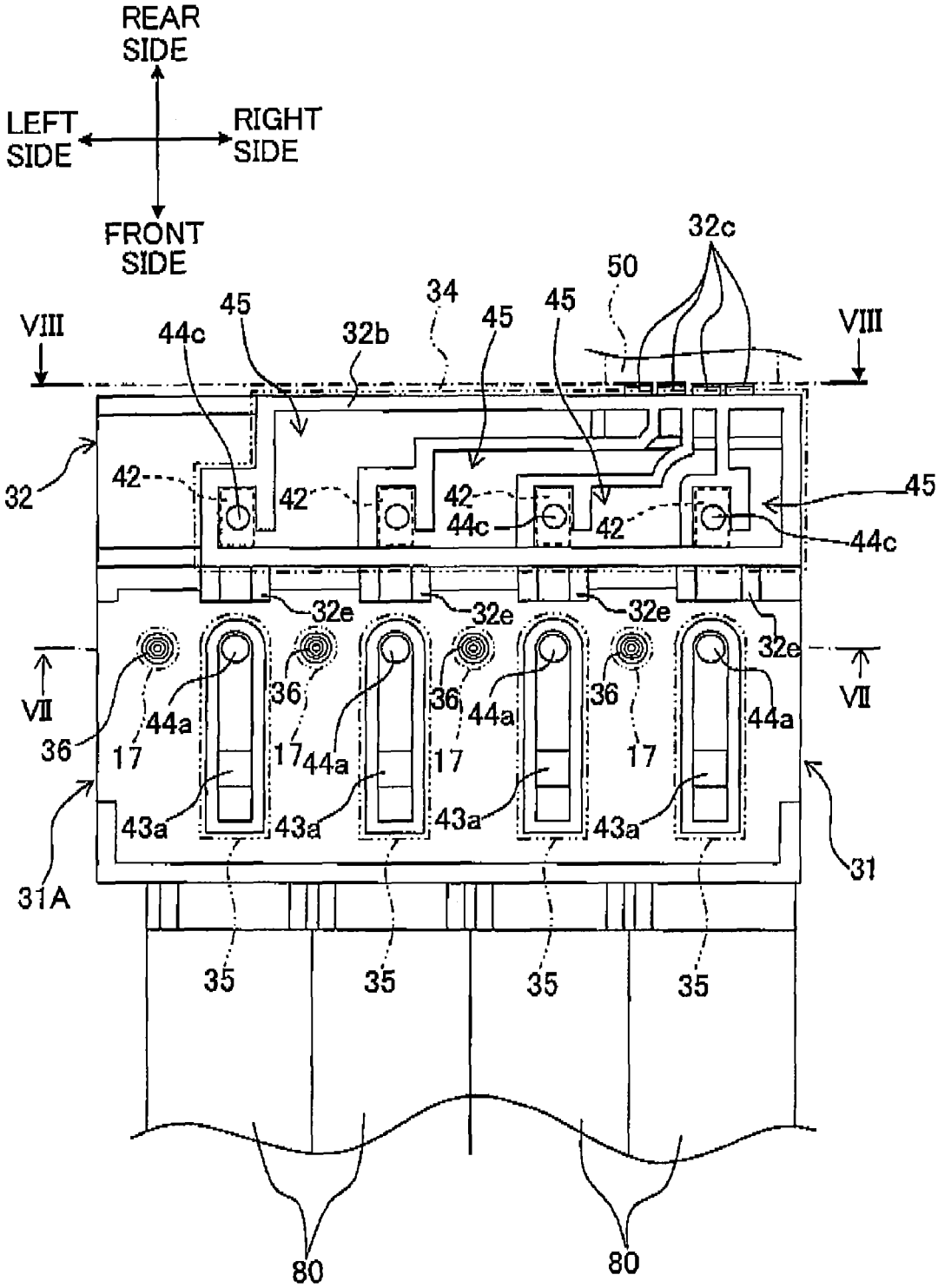
FIG. 6 is a plan view of a sub tank taken along a line VI-VI in FIG. 5.
Figure 7:
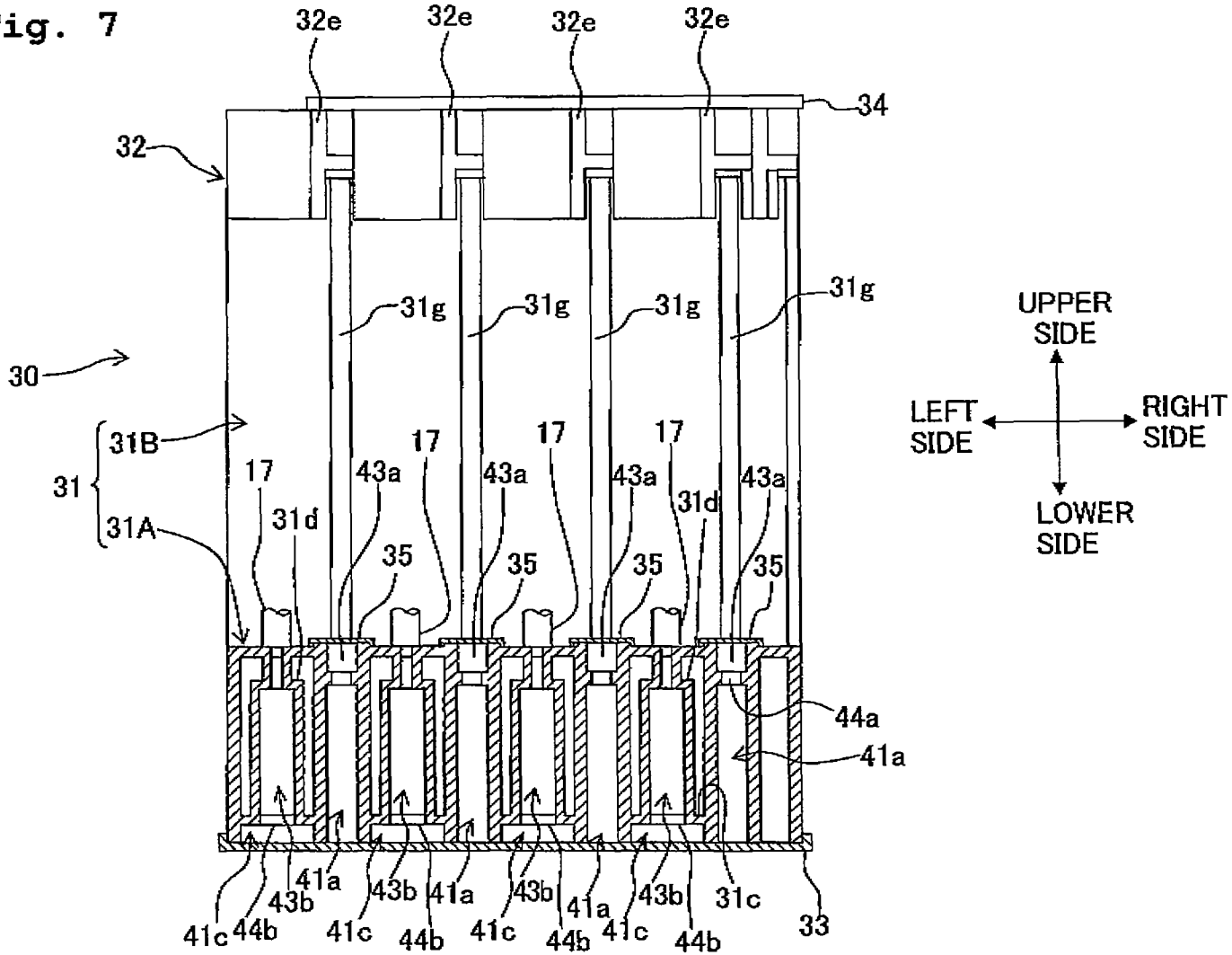
FIG. 7 is a front cross-sectional view of the sub tank taken along a line VII-VII in FIG. 6.

FIG. 5 is a side cross-sectional view of the sub tank 30, FIG. 6 is a plan view of the sub tank 30, taken along a VI-VI line in FIG. 5, and FIG. 7 is a front cross-sectional view of the sub tank 30 taken along a VII-VII line in FIG. 6. As shown in FIGS. 5 to 7, the sub tank 30 includes a tank base 31 connected to the main tank 80, and a tank head 32 provided to cover the tank base 31 from an upper side. The tank base 31 and the tank head 32 are formed by injection molding of a resin material. As shown in FIG. 6, a bottom cover 33 is provided to cover an opened lower end surface of the tank base 31, and a top cover 34 is provided to cover an opened upper end surface of the tank head 32. Accordingly, an internal space which is substantially sealed is formed in the sub tank 30. Four ink storage chambers 40 which are arranged to be lined in a left right direction on a side of the tank base 31 and four labyrinth chambers 45 which are formed on a side of the tank head 32, are formed in the internal space of the sub tank 30.

The tank base 31 has a lower portion 31A covered by the bottom cover 33, an erected portion (standing portion, protruding portion) 31B which is provided to be extended upward from the upper end surface of the lower portion 31A, and the needle portion 31C which is provided to be protruded frontward from the lower portion 31A. A lower portion area 41 of the ink storage chamber 40 is formed at an interior of the lower portion 31A, and an upper portion area 42 of the ink storage chamber 40 is formed in the erected portion 31B. The lower portion area 41 of the ink storage chamber 40 communicates with an entrance passage 43*a*, formed to open in an upper end surface of the lower portion 31A, via an ink inflow hole 44*a* which penetrates the lower portion area 41 from an upper side to a lower side. An opening of the entrance passage 43*a* is covered by a channel cover 35 from an upper side. The needle portion 31C is hollow, and a rear end opening of the hollow portion communicates with the entrance passage 43*a*.

As shown in FIGS. 5 and 7, the lower portion area 41 of the ink storage chamber 40 is partitioned into an upstream portion 41*a*, a storage portion 41*b*, and a downstream portion 41*c*, by two vertical walls 31*a* and 31*b* which are provided at an interior of the lower portion 31A of the sub tank 30. The ink inflow hole 44*a* is formed in the upper stream portion 41*a*. The storage portion 41*b* is positioned at a rear side of the upstream portion 41*a*, and the downstream portion 41*c* is positioned at a left side of the upstream portion 41*a*. The upstream portion 41*a* communicates with the downstream portion 41*c* via the storage portion 41*b*. As shown in FIG. 7, an upper end of the downstream portion 41*c* is defined by a wall 31*c* which is extended horizontally. An ink outflow hole 44*b* which cuts through the wall 31*c* is formed in the wall 31*c*. A cylindrical portion 31*d* which is extended upward from a periphery of the ink outflow hole 44*b* is formed on an upper end surface of the wall 31*c*, and a discharge passage 43*b* which communicates with the downstream portion 41*c* via the ink outflow hole 44*b* is formed at an interior of the cylindrical portion 31*d*. The discharge passage 43*b* communicates with a tube connecting portion 36 in the form of a tube which is arranged adjacent to a left side of the ink inflow hole 44*a* on an upper end surface of the lower portion 31A of the tank base 31. The tube connecting portion 36 is provided to be protruding upward, and the abovementioned supply tube 17 is inserted, from an upper side, to connect to the connecting portion 36.

A cylindrical portion 31*e* having a rectangular cross section extending vertically is provided to the erected portion 31A of the tank base 31, and the upper portion area 42 of the ink storage chamber 40 is formed by being surrounded by an inner peripheral surface of the cylindrical portion 31*e*. As shown in FIG. 5, a lower end of the cylindrical portion 31*e* opens in the storage portion 41*b*, and accordingly, the lower portion area 41 and the upper portion area 42 communicate mutually. An upper end opening of the cylindrical portion 31*e* is closed by a lower end surface of the tank head 32.

The tank head 32 has a peripheral wall which surrounds a front, a rear, a left, and a right sides (all four sides), and a bottom wall portion 32*a* which forms a lower end surface. As shown in FIG. 6, four communicating holes 44*c* which are cut vertically through the bottom wall portion 32*a* are formed in the bottom wall portion 32*a* of the tank head 32, at positions closing the upper end opening of each cylindrical portion 31*e*. Moreover, four boss portions 32 which open back and forth (frontward and rearward) upon protruding slightly rearward are provided on a rear side wall 32*b* of the tank head 32, and an atmosphere communicating hole 44*d* is formed at an interior of the boss portion 32*c*. Furthermore, an inner wall having a predetermined shape is provided in an inner side area of the periphery wall of the tank head 32, and the four labyrinth chambers 45 are defined by the inner wall, the bottom wall portion 32*a*, and the top cover 34. One communicating hole 44*c* and one boss portion 44*d* open in each labyrinth chamber 45. Consequently, the lower portion area 41 of the ink storage chamber 40 is opened to the atmosphere via the upper portion area 42, the communicating hole 43*c*, the labyrinth chamber 45, and the atmosphere communicating hole 44*d*.

Figure 8:
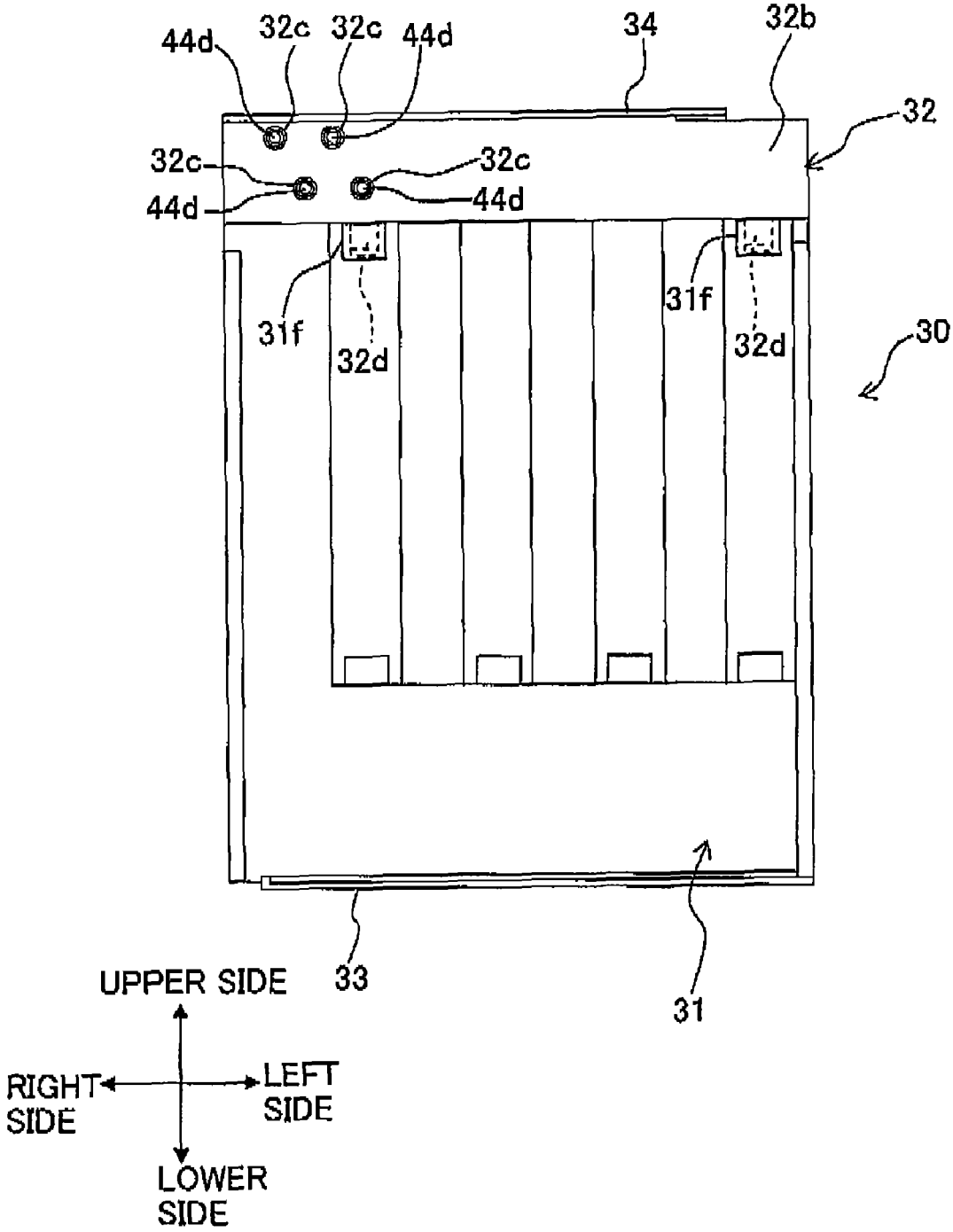
FIG. 8 is a rear view of the sub tank taken along a line VIII-VIII in FIG. 6.

FIG. 8 is a rear view of the sub tank 30, taken along an VIII-VIII line in FIG. 6. As shown in FIG. 8, the four boss portions 32*c* are formed to be arranged in two rows vertically (in two vertical rows), and also are arranged alternately upon shifting positions in a left right direction of the two boss portions 32*c* provided in each row. In such manner, the four boss portions 32*c* are arranged to be concentrated with a density of arrangement higher than a density of arrangement of the internal space and the needle portion 31*c*, in a direction of alignment (left right direction) of the needle portion 31C and the four internal spaces of the sub tank 30.

According to the sub tank 30 having a structure described above, when the main tank 80 is installed to the main tank installing portion 6, the needle portion 31C is inserted into the ink supply hole 82 of the main tank 80. Accordingly, the ink supply valve 87 opens the ink supply hole 82, and the ink storage chamber 81 of the main tank 80 communicates with the ink storage chamber 40 of the sub tank 30 via the lower portion valve accommodating chamber 83, the ink supply hole 82, the needle portion 31C, the entrance passage 43*a*, and the ink inflow hole 44*a*. The ink which has flowed into the upstream portion 41*a* of the lower portion area 41 of the ink storage chamber 40 of the sub tank 30 is guided to the downstream portion 41*c* via the storage chamber 41*b*, and then guided upward in the discharge passage 43*b* by passing through the ink outflow hole 44*b*, and is supplied to the supply tube 17 (refer to FIG. 7).

As shown in FIG. 8, two lock pins 32*d* protruding downward are formed integrally on a lower end surface of the tank head 32, and two bosses 31*f* which receive the lock pins 32*d* are formed at an upper end of the erected portion 31B of the tank base 31. The tank head 32 is assembled with the tank base 31 such that the lock pin 32*d* is engaged with the boss 31*f*. Accordingly, the tank head 32 is positioned with respect to the tank head 32, and it is possible to assemble the ink storage chamber 40 and the labyrinth chamber 45 to be communicating assuredly. Moreover, as shown in FIG. 7, four reinforcing ribs 31*g* which are extended vertically upon being protruded front ward from the erected portion 31B are provided to the tank base 31, and accordingly, a stiffness of the erected portion 31B is secured. A pinching portion (holding portion) 32*e* which pinches (holds) the reinforcing rib 31*g* is provided on a front surface of the tank head 32, and accordingly, the tank head 32 is assembled solidly (firmly) on both sides with respect to the tank base 31.

This printer unit P is provided with a carriage valve 50 which opens and closes four communicating holes 44*d*. A structure and an operation of the carriage valve 50 will be described below by referring to FIGS. 9 to 12.

Figure 9:
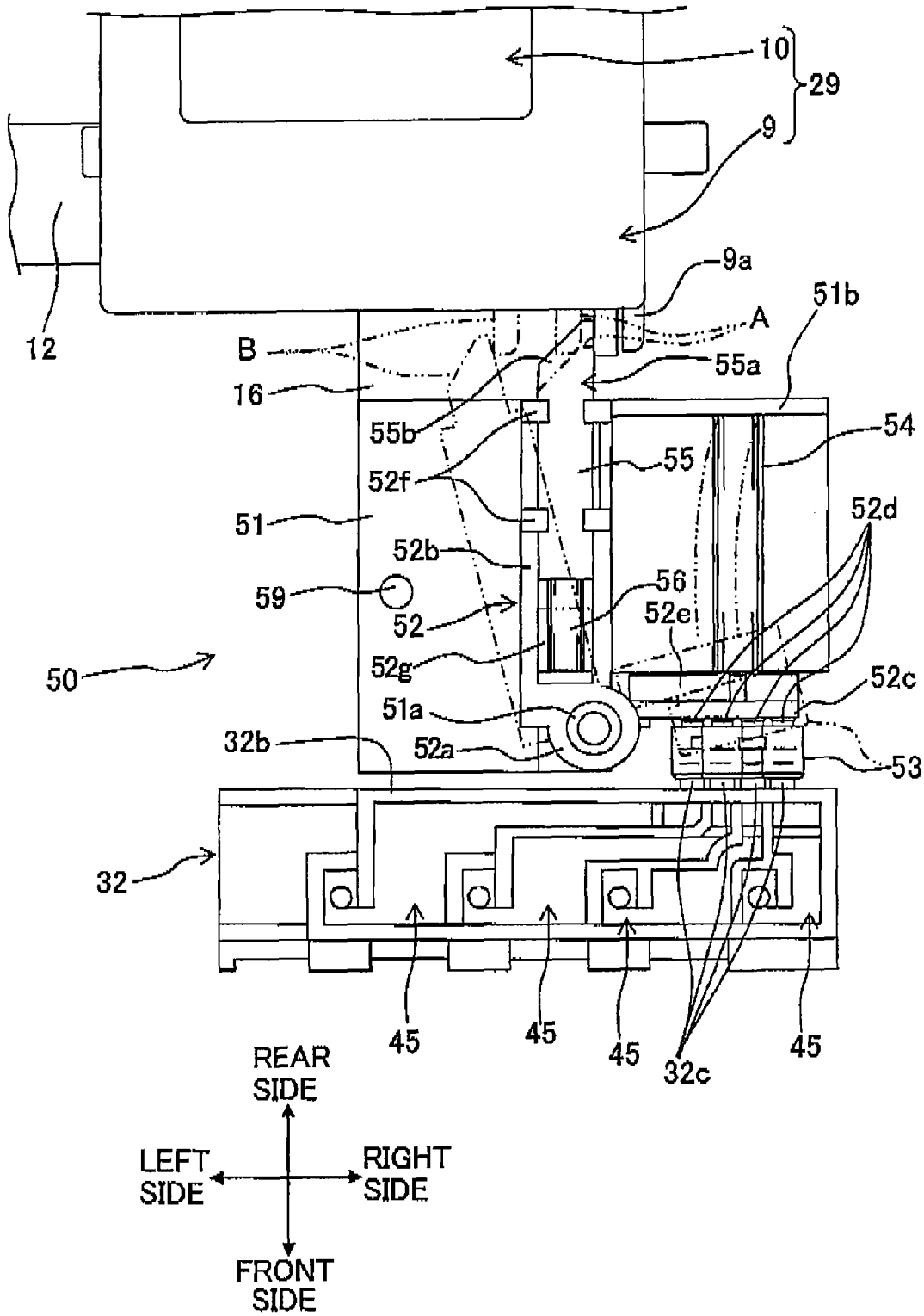
FIG. 9 is a plan view of an interior of a casing of the printer unit, showing a structure of a carriage valve.

FIG. 9 is a plan view of the interior of the casing 1 of the printer unit P, and shows a periphery (surrounding area) of the carriage valve 50 in an enlarged form, and also shows an arrangement in which the carriage 9 is at the cap position. As shown in FIG. 9, the motor plate 16 described above is provided to be extended frontward, at a right end portion of the carriage frame 12. A valve base 51 which supports various members of the structure of the carriage valve 50 is installed at a front end surface of a portion extended frontward of the motor plate 16. Positioning holes of cross-sectional circular shape are formed in the motor plate 16 and the valve base 51, respectively, and at the time of assembling the motor plate 16 and the valve base 51, a lock pin 59 is inserted upon matching shafts of the both positioning holes. Accordingly, the valve base 51 is positioned with respect to the motor plate 16. A circular cylindrical portion 51*a* protruding upward is provided at a front end portion of an upper end surface of the valve base 51. A valve arm 52 is rotatably supported around a vertical shaft of the circular cylindrical portion 51*a*.

The valve arm 52 has a boss portion 52*a* which is installed at an outer side of the circular cylindrical portion 51*a*, and a first arm portion 52*b* and a second arm portion 52*c* in the form of a plate protruding from the boss portion 52*a*. The first arm portion 52*b* and the second arm portion 52*c* are extended in a mutually orthogonal direction, and the valve arm 52 as a whole is formed to be L shaped in a plan view. The first arm portion 52*b* is extended in a substantially front and rear direction with a flat surface directed vertically in an assembled state, and is supported to be mounted on an upper end surface of the valve base 51. On the other hand, the second arm portion 52*c* is provided upon maintaining a predetermined clearance at a front side from a front end edge of the valve base 51, and is extended in a substantially left right (horizontal) direction.

Four protrusions (protruding portions) 52*d* which protrude frontward are provided at a front end portion of the second arm portion 52*c*, and a valve body (valve member) 53 made of a rubber material is installed on the protrusion 52*d*. A protrusion (protruding portion) 52*e* which protrudes rearward is provided to the second arm portion 52*c*. A lower end of the protrusion 52*e* is supported by the upper end surface of the valve base 51. A vertical wall portion 51*b* is provided at an upper side of a right portion of a rear end edge of the other valve base 51. One end of a return spring 54 such as a coil spring is press fitted to the protrusion 52*e*. The vertical wall portion 51*b* supports the other end of the return spring 54. The return spring 54 is compressed in advance, and is in a state of exerting its spring force. Consequently, a bias is applied all the time on the valve arm 52 in a clockwise direction in a plan view, by the return spring 54, and the four valve bodies 53 make a close contact with the boss portion 32*c* of the sub tank 30. Then the atmosphere communicating hole 44*d* is closed, and the ink storage chamber 40 of the sub tank 30 is in a closed state. As it has been described above, since the four boss portions 32*c* are arranged to be concentrated with a high density of arrangement, it is possible to let a structure such that the valve bodies 52 are also arranged compactly. Moreover, the valve body 53 which closes simultaneously the four boss portions 32*c* is provided to the one valve arm 52, and the carriage valve 50 which opens and closes the plurality of atmosphere communicating holes 44*d* is structured simply.

Moreover, two sets of a pair of hamulus portion (hook portion) 52*f* are provided at frontward portions and rearward positions away from the frontward positions, respectively, and by these hamulus portions 52*f*, a valve link 55 is slidably supported in a direction of extension of the first arm portion 52*b*. A groove 52*g* which is extended frontward and rearward is formed on an upper end surface of the first arm portion 52*b*, and a link spring 56 is accommodated in a compressed form in this groove 52*g*. One end of the link spring 56 is press fitted to a protrusion (protruding portion) (not shown in the diagram) which is protruded rearward from a front end of the groove 52*g*, and the other end of the link spring 56 is press fitted to a protrusion (protruding portion) (not shown in the diagram) which is protruded frontward from a rear end of the link arm 55. Consequently, a bias is applied all the time to the valve link 55 in a rearward direction by the link spring 56. A rearward movement of the valve link 55 due to the bias applied is restricted to a rear end of the link spring 56 being supported by making a contact with a rear end surface of the groove 52*g*, and is stationary at this restricting position (limit position) all the time. When the valve link 55 is at this restricting position, a front end portion 55*a* of the valve link 55 protrudes rearward with respect to the valve base 51. A left side of the front end portion 55*a* is chamfered to form a tapered surface 55*b*.

A carriage rib 9*a* is fixed to be protruding rearward, to a rear right corner of the carriage 9. When the valve link 55 is at the restricting position, the carriage rib 9*a* and the front end portion 55*a* of the valve link 55 overlap in a side view.

Figure 10:
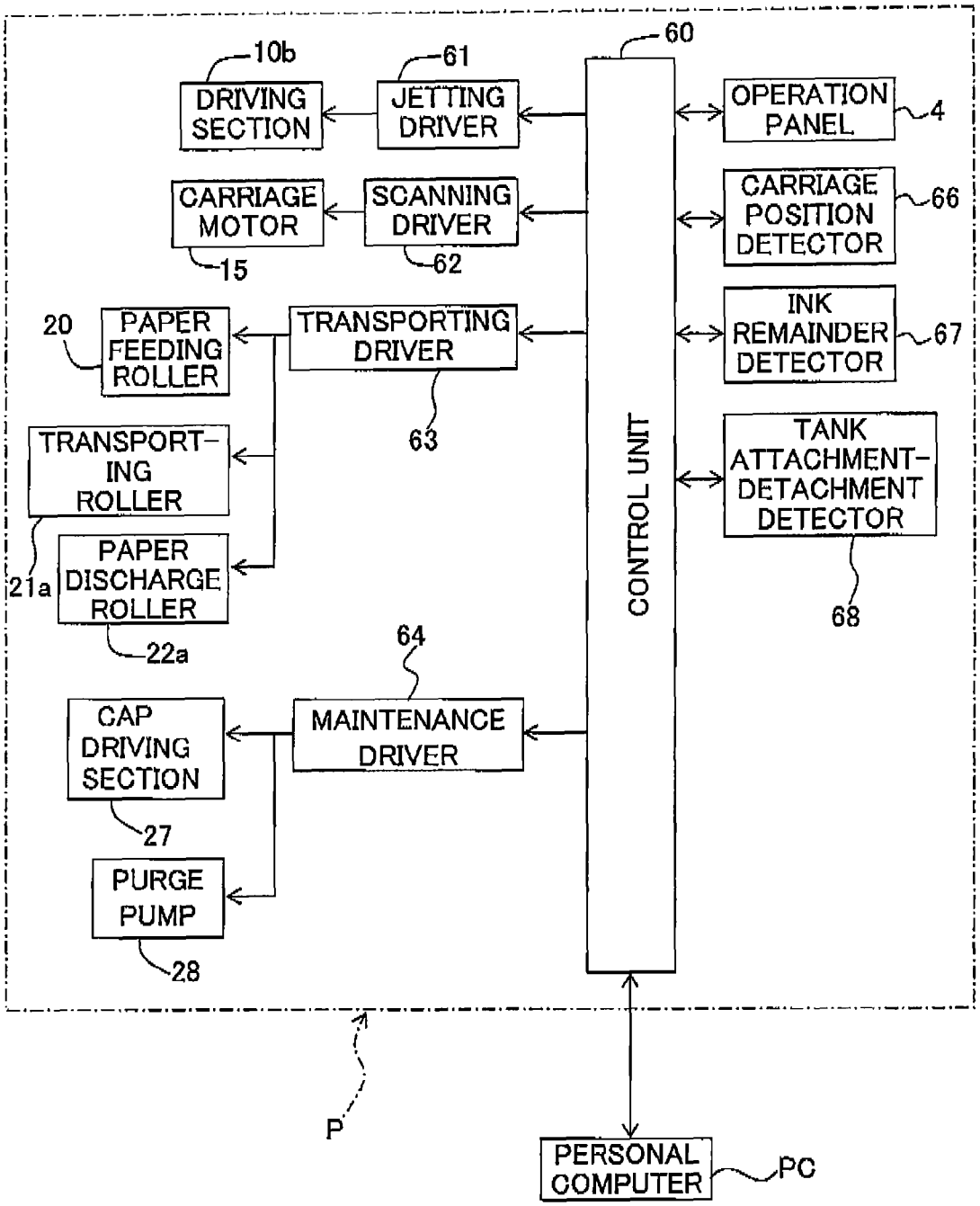
FIG. 10 is a block diagram showing a structure of a control unit of the printer unit.

FIG. 10 is a block diagram showing a structure of a control unit 60 of the printer unit P. The control unit 60 is a micro computer which includes a CPU, a ROM (Read Only Memory), a RAM (Random Access Memory), and an input-output interface, and is installed in the casing 1. The operation panel 4 described above is connected to the control unit 60, and a personal computer PC is connectable as an external equipment. Moreover, a carriage position detector 66 which is provided on the guide frame 11 as shown in FIG. 2, and which detects a movement position of the carriage 9, an ink remainder detector 67 described above, and a tank attachment-detachment detector 68 which detects whether or not the main tank 80 is installed in the main tank installing portion 6 are connected to the control unit 60. Furthermore, a jetting driver 61 which carries out a drive control of the drive portion 10*b* of the jetting head 10; a scanning driver 62 which carries out a drive control of the carriage motor 15; a transporting driver 63 which carries out a drive control of the paper feeding roller 20, the transporting roller 21*a*, and the paper discharge roller 22*a*; and a maintenance driver 64 which carries out a drive control of the cap ascending and descending section (cap driving section) 27 and the purge pump 28 are connected to the control unit 60. The tank attachment-detachment detector 68 includes a limit switch which is provided to the main tank installing portion 6 as shown in FIG. 2 for example. Each of the jetting driver 63, the scanning driver 62, the transporting driver 63, and the maintenance driver 64 has an electric circuit in-built in an IC chip etc.

Figure 11A:
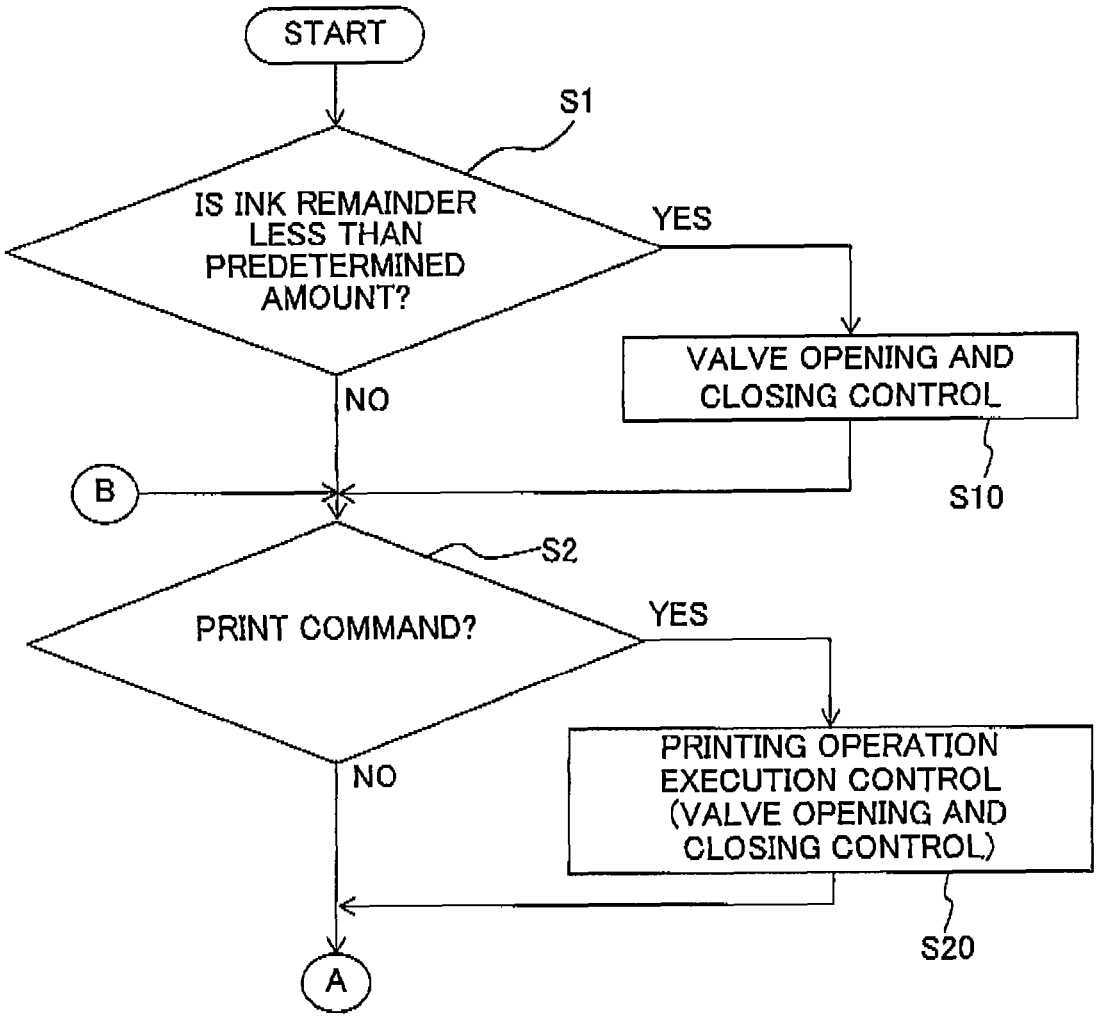
FIGS. 11A and 11B are flowcharts explaining a process which is carried out by the control unit.
Figure 11B:
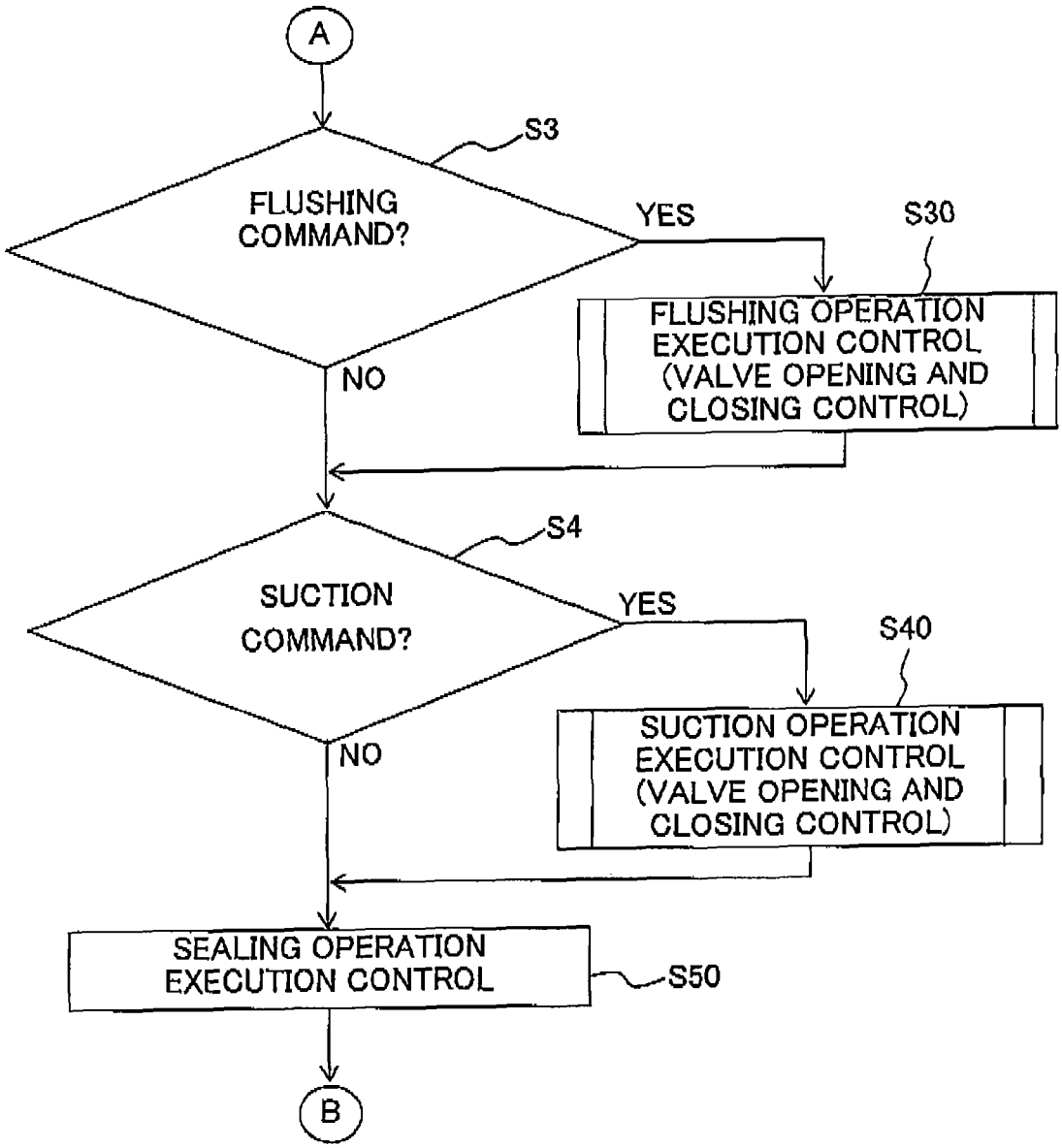

FIG. 11 is a flowchart showing a process content of a control program which is executed all the time by the control unit 60. The control unit 60 makes a judgment of whether or not an ink remainder (an amount of ink remained) is less than a predetermined amount (in other words, whether or not it is necessary to replace the main tank 80), based on a detection signal which is input from the ink remainder detector 67 at a start up (step S1). When the ink remainder is less than the predetermined amount, the control unit 60 carries out a valve opening and closing control according to a control program which is stored in the ROM (step S10). The valve opening and closing control is a computer program for controlling an opening and closing operation of the carriage valve 50 by the control unit 60, and a process content thereof will be described later. Whereas, when the ink remainder is not less than the predetermined amount, the control unit 60 makes a judgment of whether or not there has been a command for executing the printing operation, a command for executing the flushing operation, and a command for executing the suction operation (step S2 to step S4).

When image data is transferred from the personal computer PC and the command for executing the printing operation is made, the control unit 60 carries out a printing operation execution control according to the control program which is stored in the ROM (step S20). In other words, the control unit 60 outputs a control signal to the jetting driver 61, the scanning driver 62, and the transporting driver 63, and causes the recording paper M to be transported along the paper transporting path 19 as well as causes the ink to be jetted appropriately from the jetting head 10 while reciprocating the carriage 9 to left and right in the printing area. Accordingly, an image corresponding to the image data is recorded on the recording paper M. When the command to execute the flushing operation, is made by an operation on the operation panel 4, the control unit 60 carries out a flushing operation execution control (step S30) according to the control program which is stored in the ROM. In other words, the control unit 60 outputs a control signal to the scanning driver 62 and stops the carriage 9 upon moving up to the flushing position, and outputs a control signal to the jetting driver 61 and causes the ink to be jetted from the jetting head 10. When the command to execute the suction operation is made, by an operation on the operation panel 4, the control unit 60 carries out a suction operation execution control (S40) according to the control program which is stored in the ROM. In other words, the control unit outputs a control signal to the scanning driver 62, and stops the carriage 9 upon moving up to the cap position, and outputs a control signal to the maintenance driver 64 and moves the suction cap 26 upward, and outputs a control signal to the maintenance driver 64 and operates the purge pump 28 for a predetermined time.

When there is no command for executing each operation described above, the control unit 60 carries out a sealing operation execution control (step S50). In other words, the control unit 60 outputs a control signal to the scanning driver 62 and stops the carriage 9 upon moving up to the cap position, and outputs a control signal to the maintenance driver 64 and moves the suction cap 26 upward. In other words, as it is evident from a flow of returning from step S50 to step S20, the sealing operation is continued till the command to execute each operation is inputted. According to the printer unit P, it is structured to standby with the nozzle holes in a sealed state, and an area around the nozzle holes is hardly dried.

During the execution of the printing operation execution control (step S20), the flushing operation execution control (step S30), and the suction operation execution control (step S40), the ink is discharged from the jetting head 10 and the ink in the main tank 80 is consumed. Therefore, even during the execution of each control (steps S20, S30, and S40) a same judgment process as in step S10 is carried out, and when a judgment is made that the ink remainder is less than the predetermined amount in the judgment process, the control being executed is discontinued, and the valve opening and closing control (step S10) is stared.

Figure 12A:
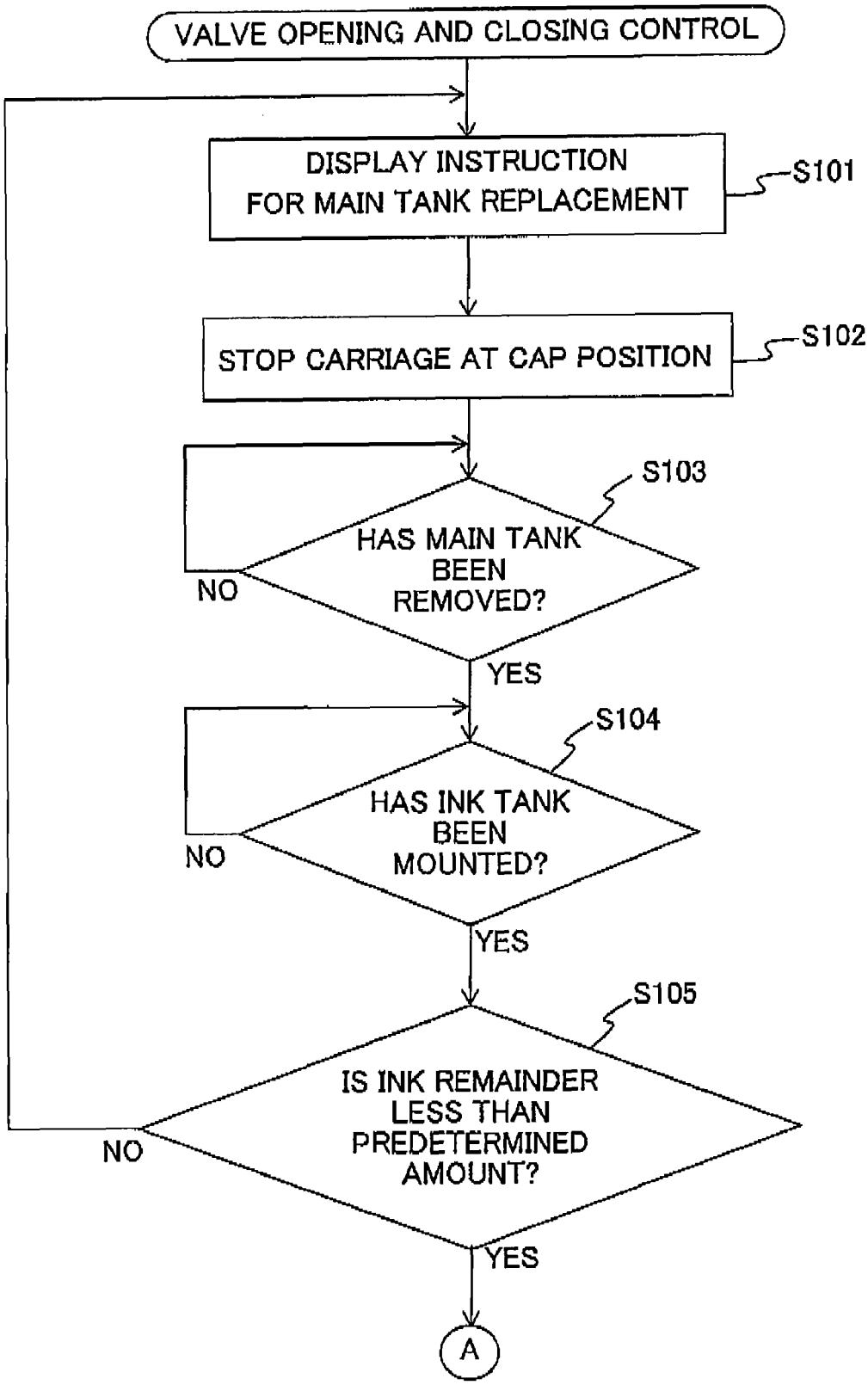
FIGS. 12A and 12B are flowcharts explaining a process of a valve opening and closing control which is carried out by the control unit.
Figure 12B:
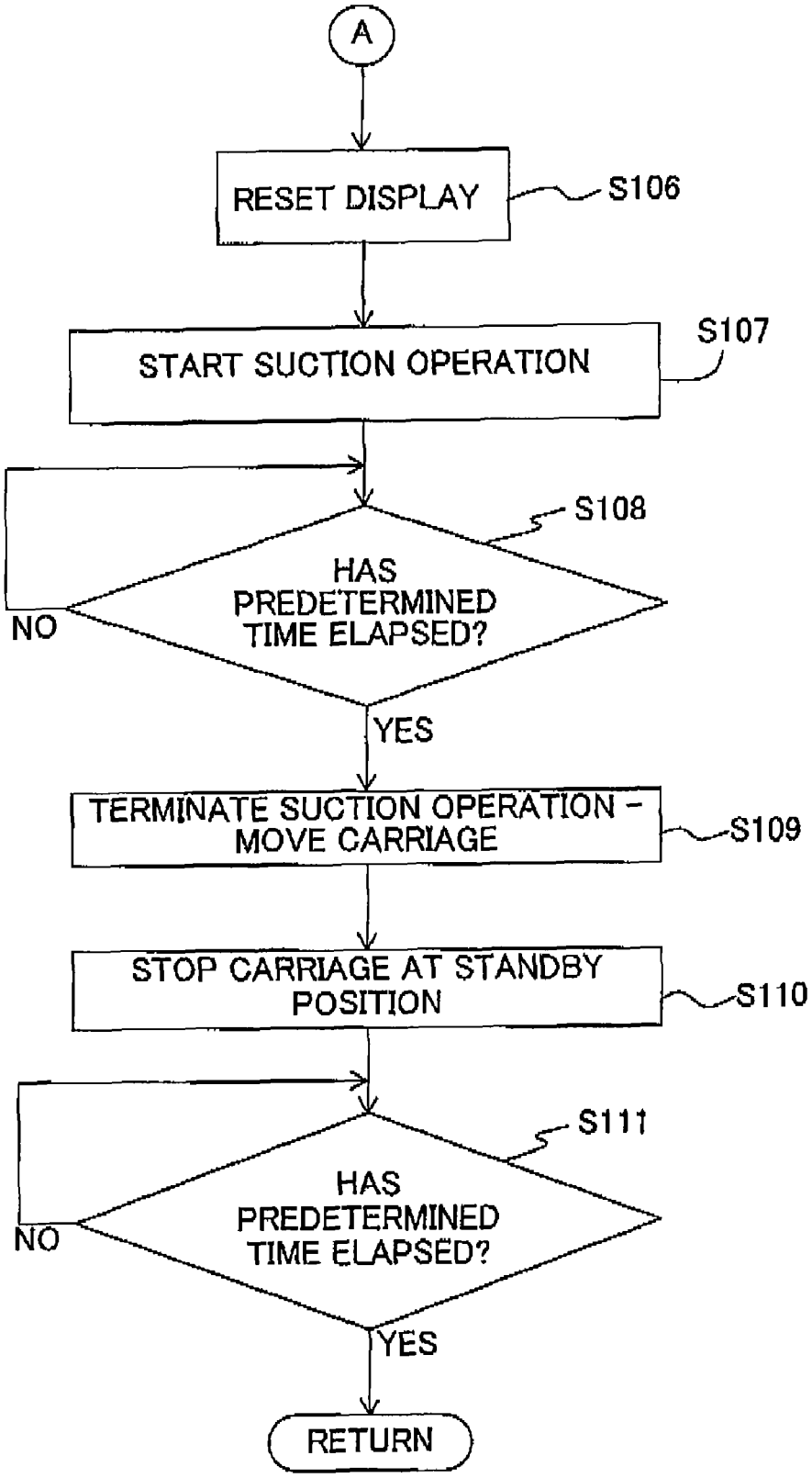

FIG. 12 is a flow chart describing a process content of the valve opening and closing control (step S10). As shown in FIG. 12, firstly, a message instructing the replacement of the main tank 80 to an operator is displayed on the operation panel 4 and the personal computer PC (step S101), and the carriage 9 is moved to the cap position by outputting a control signal to the scanning driver 62 (step S102).

When the carriage 9 moves from the printing position to the cap position for example, the cap rib 9*a* makes a contact from a left side with the tapered surface 55*b* of the front end portion 55*a* of the valve link 55. Due to the movement of the carriage 9, when the carriage rib 9*a* pushes the front end portion 55*a* of the valve link 55 to right, the valve link 55 is retracted frontward resisting the bias applied by the link spring 56 as shown by alternate long and short dash lines A in FIG. 9 (wedge effect). At this time, almost no force in a direction of rotation around an axis acts on the valve arm 52, and there is no swing-movement of the valve arm 52. When the carriage 9*a* moves toward right surpassing the valve link 55 upon being retracted frontward, the bias is applied to the valve link 55 by the link spring 56, and the valve link 55 returns to the restricting position.

Moreover, the door 5 of the printer unit P is provided with a locking mechanism (not shown in the diagram) which locks the door 5 in a closed state (when closed). The lock of the door 5 is released only when the carriage 9 is at the cap position. When the carriage moves up to the cap position, it is possible to remove the main tank 80 installed in the main tank installing portion 6 and reinstall the main tank 80 through the opening of the door 5.

When the main tank 80 is removed, a front end of the needle portion 31C opens to an outside. However, since the atmosphere communicating hole 44*d* is closed by the carriage valve 50, the internal space of the sub tank 30 is not opened to the atmosphere. Therefore, even when the ink is filled in the entrance passage 43*a* and the needle portion 31C of the sub tank 30, the ink does not flow to the outside from the front end opening of the needle portion 31C. Whereas, when the main tank 80 is installed in the main tank installing portion 6, a possibility of air entering into the needle portion 31C is high, and when the air enters inside, a meniscus is formed inside the needle portion 31C, and the ink might not flow from the main tank 80 to the sub tank 30.

In the control unit 60, after the end of step S102, a judgment of whether or not the main tank 80 has been removed is made based on a detection signal which is inputted from the tank attachment-detachment detector 68 (step S103), and this judgment process is repeated till the main tank 80 is judged to be removed. When a judgment that the main tank 80 has been removed is made, a judgment of whether or not the main tank 80 has been reinstalled is made based on a detection signal of the tank attachment-detachment detector 68 (step S104), and this judgment process is repeated till a judgment that the main tank 80 has been installed is made. When the judgment that the main tank 80 has been installed is made, a judgment of whether or not the ink in the main tank is not less than the predetermined amount is made based on a detection signal which is inputted from the ink remainder detector 67 (step S105). Here, when a judgment that the ink in the main tank 80 is less than the predetermined amount is made at step S105 after the process at steps S103 and S104, it means that an empty main tank 80 has been installed by mistake. Consequently, when the judgment is made that the ink in the main tank 80 is less than the predetermined amount at step S106, the process returns up to step S101, and a judgment process at steps S103 to S105 is carried out again.

When the judgment is made at step S105 that the ink remained in the main tank 80 is not less than the predetermined value, it is assumed that a new main tank 80 has been installed, and the display of instructing the replacement being carried out by step S101 is stopped (step S106), the control unit 60 outputs a control signal to the maintenance driver 64, and starts the suction operation (step S107). By this initial discharge operation, the ink is sucked forcibly through the nozzle holes in the jetting head 10, and the ink in the buffer tank 18, the supply tube 17, and the ink storage chamber 40 of the sub tank 30 is consumed. Accordingly, a negative pressure is generated inside the ink storage chamber 40, and the meniscus in the needle portion 31C is destroyed, and it is possible to let escape the air entered at the time of installing the main tank 80, to the internal space of the sub tank 30. The initial ink discharge operation may involve discharging by sucking forcibly the ink and the air inside the ink storage chamber 40 toward the supply tube 17, and generating the negative pressure inside the ink storage chamber 40, and is not restricted to discharge forcibly through the nozzle holes in the jetting head 10. Therefore, a hole which allows communication with the outside may be formed in a common ink chamber in the jetting head 10, and this hole may be closed by an opening and closing valve, and the ink may be discharged forcibly by sucking through the hole in the common ink chamber. In other words, the ink may be discharged without passing through the nozzle holes.

Moreover, a judgment of whether or not a predetermined time has elapsed after starting the suction operation is made (step S108), and this judgment process is repeated till the predetermined time has elapsed. In other words, the suction operation is continued till the predetermined time has elapsed. The predetermined time is a time sufficient for destroying the meniscus, and is set in advance in the ROM. When a judgment that the predetermined time has elapsed is made, the suction operation is terminated, and the control unit 60 outputs a control signal to the scanning driver 62, and moves the carriage 9 from the cap position (step S109).

When the carriage moves toward left from the cap position shown in FIG. 9, the carriage rib 9*a* makes a contact from a right side of the front end portion 55*a* of valve link 55. Since the right end of the valve link 55 is directed frontward and rearward, when the carriage rib 9*a* pushes the valve link 55 to left along with the movement of the carriage 9, the valve link 55 is linked (interlocked) with the valve arm 52 supporting the valve link 55 as shown by alternate long and short dash lines in FIG. 9. When the valve link 55 is linked with the valve arm 52, the valve arm 52 and the valve link 55 rotate in an counterclockwise direction in a plan view around the shaft of the boss portion 52*a* of the valve arm 52, resisting the bias applied by the return spring 54. Due to the rotation, a front end portion of the second arm portion 52*c* of the valve arm 52 is directed rearward, and oscillates within the clearance described above. Accordingly, the valve body 53 is repelled (separated) rearward from the rear side wall 32*b* of the tank head 32 of the sub tank 30, and the atmosphere communicating hole 44*d* is opened.

Further, when a judgment is made that the carriage valve 50 has moved to a predetermined standby position at which the atmosphere communicating hole 44*d* opens (refer to FIG. 3), based on a detection signal which is input from the carriage position detector 66, the carriage 9 stops at this standby position (step S110). It is possible to know the standby position in advance from an arrangement (positional relationship) of the carriage rib 9*a* and the valve link 55, and is set in advance in the ROM.

After the meniscus which is developed at the time of mounting is destroyed, when the atmosphere communicating hole 44*d* is opened in such manner, the ink flows from the main tank 80 into the sub tank 30 due to a water head pressure, and a height of the liquid level inside the ink storage chamber 81 of the main tank 80 and a height of the liquid level in the ink storage chamber 40 of the sub tank 30 become same. Thus by flowing of the ink into the sub tank 30 in such manner, it is possible to supply the ink sufficiently to the supply tube 17, the buffer tank 18, and the cavity unit 10*a* of the jetting head 10.

Further, a judgment of whether or not a predetermined time has elapsed after the carriage 9 has stopped at the standby position is made (step S111), and this judgment process is carried out repeatedly till the predetermined time has elapsed. This predetermined time is a time which is sufficient for making same the height of the liquid levels, and is set in advance in the ROM. When a judgment that the predetermined time has elapsed is made, the valve opening and closing control (step S10) is terminated, and the process returns to step shown in FIG. 11. In other words, when the valve opening and closing control (step S10) is started immediately after the start up, the process advances to step S2, after returning. Moreover, when the valve opening and closing control (step S10) is started upon discontinuing the printing operation execution control (step S20), the process returns to step S20 after returning, and the printing operation is restarted. When the valve opening and closing control (step S10) is started upon discontinuing the flushing operation execution control (step S30), the process may return to step S30 after returning, or may advance to the next step S40. Similarly, even when the valve opening and closing control (step S10) is started upon discontinuing the suction operation execution control (step S40), the process may return to step S40 after returning, or may advance to the next step S50.

In any of the cases, when the valve opening and closing control (step S10) ends, and the process returns to a step shown in FIG. 11, the carriage 9 moves from the standby position to the printing area, or the flushing position, or the cap position. When the carriage 9 moves to the printing area or the flushing position, the carriage rib 9*a* pushes the valve link 55 to further left, and the valve arm 52 rotates till the carriage rib 9*a* moves over the front end portion 55*a* of the valve link 55. When the carriage rib 9*a* moves over the valve link 55, the bias is applied to the second arm portion 52*c* in a frontward direction by the force imparted by the return spring 54, and the valve arm 52 swings in a clockwise direction in a plan view around the shaft of the boss portion 52*a*. Moreover, the valve body 53 makes a close contact with the boss portion 32*c* such that the atmosphere communicating hole 44*d* is closed, and the swing (rotation) of the valve arm 52 are restricted. Moreover, when the carriage 9 moves to the cap position, the carriage rib 9*a* moves toward right. With this movement, the valve arm 52 rotates in the clockwise direction in a plan view due to the bias applied by the return spring 54 similarly as it has been described above, and the valve body 53 makes a close contact with the boss portion 32*c* such that the atmosphere communicating hole 44*d* is closed.

As it has been described above, according to the printer unit P in the embodiment, when the main tank 80 is installed, the carriage valve 50 closes the atmosphere communicating hole 44*d*, and when the new main tank 80 is installed in the main tank installing portion 6, after the suction operation is carried out with the atmosphere communicating hole 44*d* closed, the atmosphere communicating hole 44*d* is opened. Consequently, even when the meniscus is formed by entry of the air into the needle portion 31C at the time of mounting the main tank 80, the meniscus is destroyed by the discharge of ink along with the suction operation, and it is possible to make the ink flow in smoothly toward the sub tank 30.

The carriage valve 50 has a structure such that the carriage valve 50 is opened and closed according to a moving position of the carriage 9. It is possible to control the opening and closing operation of the carriage valve 50 by using the movement control as before of the carriage 9, without letting an increase in a manufacturing cost.

Moreover, the carriage valve 50 has a structure such that the carriage valve 50 closes the atmosphere communicating hole 44*d* when the carriage 9 is at the cap position, and when the carriage 9 is at the cap position, the attaching and detaching of the main tank 80 upon opening the door 5 is allowed. Therefore, the main tank 80 is removed with the atmosphere communicating hole 44*d* closed assuredly, and it is possible to prevent assuredly the leaking out of the ink.

The meniscus is destroyed at the cap position at which the attaching and detaching of the main tank 80 is allowed. Therefore, it is possible to discharge the ink instantaneously, and after the main tank 80 is mounted, it is possible to shorten a time till the printer unit P has returned to a normal operating state (in other words, end the valve opening and closing control).

The embodiment according to the present invention has been described above. However, the scope of the present invention is not necessarily restricted to the description made above. For example, the ink discharge operation which is carried out after mounting the new main tank 80 in step S107 is not necessarily restricted to the suction operation. Even by changing the ink discharge operation to the flushing operation, it is possible to destroy the meniscus similarly. Moreover, when the valve opening and closing control at step S10 is started upon discontinuing the printing operation execution control at step S20, the ink may be discharged by temporarily restarting the printing operation at step S107. Accordingly, it is possible to facilitate shortening the time required for printing, and to decrease an amount of waste ink as compared to the amount of waste ink in a structure in which the suction operation and the flushing operation are carried out.

Moreover, in the embodiment described above, the structure is made to be such that the carriage valve 50 is operated by the carriage rib 9*a* installed on (fixed to) the carriage 9. However, the structure may be such that a mechanism which is electromagnetically driven is provided, and a drive control of the mechanism is carried out corresponding to the movement position of the carriage 9. Moreover, in the embodiment described above, the cap position is let to be the right-end limit position of the scanning range, and the standby position is set between the printing area and the cap position. However, it is possible to change the standby position appropriately according to an arrangement of the sub tank 30.

Moreover, the cap position, the standby position, and the flushing position of the maintenance area are not restricted to the arrangement (positional relationship) shown in FIG. 3. For example, an arrangement may be such that, the standby position and the cap position may be positioned in order of the standby position and the cap position at the right end side of the printing area, along a direction separating from the printing area of the scanning direction of the image recording unit 29, and the flushing position is at a left end side of the printing area. Furthermore, in a case of such arrangement, it is also possible to overlap the standby position with the printing area, and accordingly it is possible to make narrow the scanning range of the image recording unit 29, and to make small a size of the apparatus. The number of main tanks 80 to be installed in the printer unit P is not restricted to four, and it is possible to achieve the similar effect even by changing the number of main tanks 80 to three or less than three, or to five or more than five. The liquid droplet jetting apparatus according to the present invention is not restricted to an ink-jet printer apparatus, and is also applicable to an apparatus which jets any liquid other than the ink.

What is claimed is:

1. A liquid droplet jetting apparatus which jets, onto a recording medium, droplets of a liquid supplied from a main tank, comprising:

a main tank installing portion in which the main tank is detachably installed, the main tank having a storage space formed therein to store the liquid;

a sub tank which is arranged adjacent to the main tank installing portion, which is connected to the main tank when the main tank is installed in the main tank installing portion, and which has an interior space formed therein to store the liquid, an atmosphere communicating hole formed to communicate the interior space with an atmosphere, an inflow portion through which the liquid flows into the sub tank, and a valve which opens and closes the atmosphere communicating hole; and a head having a nozzle surface in which a plurality of nozzles through which the liquid supplied via the sub tank are jetted are formed, wherein when the main tank is connected to the sub tank, the storage space communicates with the interior space via the inflow portion, and wherein when the main tank is installed in the main tank installing portion, the liquid stored in the main tank is supplied to the head through the sub tank;

when the main tank is detached from the main tank installing portion, the valve is configured to close the atmosphere communicating hole; and when the main tank is being installed in the main tank installing portion, a discharge operation is performed in which the liquid is discharged from the interior space while the atmosphere communicating hole is closed, and the valve is configured to open the atmosphere communicating hole after the liquid is discharged from the interior space.

2. The liquid droplet jetting apparatus according to claim 1, further comprising a carriage which reciprocates in a predetermined direction with the head mounted thereon; wherein the valve opens or closes the atmosphere communicating hole depending on a position of the carriage.

3. The liquid droplet jetting apparatus according to claim 2, further comprising a cap mechanism which seals the nozzle surface of the head;

wherein the valve closes the atmosphere communicating hole when the carriage is positioned at a printing position at which an operation of jetting the liquid onto the recording medium from the nozzles is performed, or at a cap position at which the nozzle surface is sealed by the cap mechanism; and the valve opens the atmosphere communicating hole when the carriage is positioned at a standby position which is different from the printing position and the cap position.

4. The liquid droplet jetting apparatus according to claim 3, wherein when the carriage is positioned at the cap position, the main tank is detachable with respect to the main tank installing portion.

5. The liquid droplet jetting apparatus according to claim 3, further comprising a liquid jetting mechanism which is provided on the head, wherein in the discharge operation, the carriage is moved to the printing position, and the liquid jetting mechanism performs printing on the recording medium by jetting the liquid from the nozzles.

6. The liquid droplet jetting apparatus according to claim 3, further comprising a suction mechanism which sucks the liquid through the cap mechanism; wherein in the discharge operation, the carriage is moved to the cap position, and the suction mechanism sucks the liquid from the nozzles in the discharge operation during which the nozzle surface is sealed by the cap mechanism.

7. The liquid droplet jetting apparatus according to claim 3, wherein the atmosphere communicating hole is formed in a side surface of the sub tank, the side surface facing the carriage when the carriage is positioned at the standby position;

the valve has an arm which is swingably installed between the sub tank and the carriage, a valve element which is provided at one end of the arm, an operating piece which is provided at the other end of the arm, and a bias applying member which applies a bias on the arm in a direction such that the valve member closes the atmosphere communicating hole;

when the carriage is positioned at the printing position or the cap position, the carriage is away from the operating piece and the atmosphere communicating hole is closed by the valve member; and when the carriage is positioned at the standby position, the operating piece is pressed by the carriage to swing the arm, resisting the bias by the bias applying member, and the valve body is away from the atmosphere communicating hole and the atmosphere communicating hole is opened.

8. The liquid droplet jetting apparatus according to claim 7, wherein one end of the operating piece of the valve is contactable to the carriage, the one end being wedge-shaped and chamfered on one side in the predetermined direction.

9. The liquid droplet jetting apparatus according to claim 8, wherein the valve has a second bias applying member which pushes the operating piece toward the carriage;

the carriage has a protruding portion which is formed on the carriage and is engaged with the operating piece;

when the carriage moves from the one side in the predetermined direction to the other side, the protruding portion presses the operating piece, resisting the second bias applying member, in a direction away from the carriage; and when the carriage moves from the other side in the predetermined direction to the one side, the protruding portion is engaged with the operating piece to swing the arm, resisting the bias by the bias applying member.

10. The liquid droplet jetting apparatus according to claim 1, wherein the main tank includes a plurality of individual main tanks, and the individual main tanks are detachably installed in the main tank installing portion; the sub tank includes a plurality of individual sub tanks which are to be connected corresponding to the individual main tanks installed in the main tank installing portion, respectively; and the atmosphere communicating hole is formed as a plurality of communicating holes each of which is formed in one of the individual sub tanks, and the valve opens and closes simultaneously the atmosphere communicating holes of the individual sub tanks.

11. The liquid droplet jetting apparatus according to claim 8, wherein the individual sub tanks are aligned in a predetermined aligning direction; and the atmosphere communicating holes are arranged in the aligning direction to be concentrated with a density higher than a density of the sub tanks.

12. A method of exchanging a main tank in a liquid droplet jetting apparatus comprising a sub tank which is arranged adjacent to a main tank installing portion, and a head having a nozzle surface in which a plurality of nozzles through which the liquid supplied via the sub tank are jetted are formed, the method of exchanging the main tank comprising the steps of:

detecting a remaining amount of the liquid in a first main tank, which comprises a storage space formed therein to store the liquid and is detachably installed in the main tank installing portion;

moving a carriage to a cap position when the remaining amount of the liquid is less than a predetermined amount, wherein the carriage reciprocates in a predetermined direction with the head mounted thereon;

detaching the first main tank from the main tank installing portion;

installing a second main tank in the main tank installing portion;

sucking the liquid through a cap mechanism by a suction mechanism, while the carriage is positioned at the cap position, wherein the cap mechanism seals the nozzle surface of the head; and moving the carriage to a standby position after the liquid has been sucked.

* * * * *